US006719404B2

(12) United States Patent
Kobayashi

(10) Patent No.: US 6,719,404 B2
(45) Date of Patent: Apr. 13, 2004

(54) METHOD OF FABRICATING INK-JET HEAD

(75) Inventor: Kazuo Kobayashi, Kakamigahara (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 74 days.

(21) Appl. No.: 10/366,393

(22) Filed: Feb. 14, 2003

(65) Prior Publication Data

US 2003/0156159 A1 Aug. 21, 2003

(30) Foreign Application Priority Data

| | | |
|---|---|---|
| Feb. 15, 2002 | (JP) | 2002-038684 |
| Feb. 15, 2002 | (JP) | 2002-038771 |
| Feb. 15, 2002 | (JP) | 2002-038772 |
| Feb. 25, 2002 | (JP) | 2002-048016 |
| Feb. 25, 2002 | (JP) | 2002-048257 |

(51) Int. Cl.[7] ..... B41J 2/04
(52) U.S. Cl. ..... 347/54
(58) Field of Search ..... 347/54, 151, 120, 347/141, 154, 103, 123, 111, 159, 127, 128, 131, 125, 158, 55, 68, 69, 70, 71, 72, 50, 40, 20, 44

(56) References Cited

U.S. PATENT DOCUMENTS

| | | | |
|---|---|---|---|
| 5,402,159 | A | 3/1995 | Takahashi et al. |
| 5,734,399 | A | 3/1998 | Weber et al. |

FOREIGN PATENT DOCUMENTS

| | | |
|---|---|---|
| JP | A 3-274159 | 12/1991 |
| JP | A 9-314836 | 12/1997 |

OTHER PUBLICATIONS

U.S. patent application Ser. No. 10/366,392, Hirota et al., filed Feb. 14, 2003.
U.S. patent application Ser. No. 10/366,665, Hirota et al., filed Feb. 14, 2003.

*Primary Examiner*—Raquel Yvette Gordon
(74) *Attorney, Agent, or Firm*—Oliff & Berridge, PLC

(57) ABSTRACT

A method of fabricating an ink-jet head including forming a first photosensitive resin layer on one face of a metal flat plate, forming a second photosensitive resin layer on the other face of the metal flat plate, selectively exposing the first photosensitive resin layer by using a mask formed with a pattern corresponding to a first passage partially constituting the ink passage, removing an exposed portion or an unexposed portion of the first photosensitive resin layer, forming the first passage by etching the metal flat plate to form a shape corresponding to a removed portion of the first photosensitive resin layer, selectively exposing the second photosensitive resin layer by using a mask formed with a pattern corresponding to a second passage partially constituting the ink passage and a filter, forming the second passage connected to the first passage and the filter by removing an exposed portion or an unexposed portion of the second photosensitive resin layer, and laminating the flat plate processed by the steps of (A) through (G) onto the other flat plates.

7 Claims, 31 Drawing Sheets

METHOD OF FABRICATING INK-JET HEAD

BACKGROUND OF THE INVENTION

1. Field of Invention

The present invention relates to a manufacture method or production method of an ink-jet head for forming an image by ejecting a small liquid drop to a printing face.

2. Description of Related Art

There is a conventionally known general constitution of an ink-jet head in which a plurality of pressure chambers are formed, a nozzle is opened in correspondence with each of the pressure chambers and each nozzle is connected to one end of a corresponding pressure chamber.

According to the constitution, ink from an ink supply source (for example, ink tank) is temporarily supplied to a common ink chamber and thereafter distributed from the common ink chamber to the plurality of pressure chambers. Further, by selectively applying pressure to each of the pressure chambers by an actuator, ink is ejected from the nozzle in correspondence with the pressure chamber to thereby form an image on a printing face.

This ink-jet head is generally formed by adhering pluralities of sheets of thin flat plates made of a metal or the like in a lamination structure. The pressure chamber and the common ink chamber are formed by etching the metal plates.

Here, there is also known a constitution in which a filter is provided at a supply passage of ink connecting the common ink chamber and the ink tank (ink supply source) or an ink flow passage between the common ink chamber and the pressure chamber to thereby remove dust and dirt or an impurity before the ink reaches the pressure chamber or the nozzle so that the nozzle or the pressure chamber will not be closed by dust and dirt.

There is also known a constitution in which a flow path control means having a constitution of narrowing a sectional area of the flow passage is provided between the common ink chamber and the pressure chamber for controlling an amount of ink supplied to the pressure chamber when ejecting ink to thereby obviate an excessively large or small ink ejecting amount Here, in recent years, by needs of high resolution formation of ink-jet recording, miniaturization and high integration of the ink-jet head structure are progressed and under the situation, it is highly requested to be able to simply fabricate an ink-jet head having the above-described filter inside.

SUMMARY OF THE INVENTION

It is an object of the invention to provide a method of fabricating an ink-jet head capable of simplifying fabricating steps.

In order to achieve the above-described object, this invention proposes a manufacture method for an ink-jet head including a nozzle for ejecting ink, an ink passage connecting the nozzle and an ink supply source, and a plurality of flat plates formed with the ink passage inside in a laminated structure, including at least following (A) to (H) steps of:

(A) forming a first photosensitive resin layer on one side of a metal flat plate;

(B) forming a second photosensitive resin layer on the other side of the metal flat plate;

(C) selectively exposing the first photosensitive resin layer by using a mask formed with a pattern in correspondence with a first passage constituting a portion of the ink passage;

(D) removing an exposed portion or an unexposed portion of the first photosensitive resin layer;

(E) forming the first passage by etching the metal flat plate to form a shape in correspondence with a removed portion of the first photosensitive resin layer;

(F) selectively exposing the second photosensitive resin layer by using a mask formed with a pattern in correspondence with a second passage constituting a portion of the ink passage and a filter;

(G) forming the second passage connected to the first passage and the filter by removing an exposed portion or an unexposed portion of the second photosensitive resin layer; and (H) laminating the flat plate processed by the steps of (A) through (G) onto the other flat plates.

Thereby, the second photosensitive resin layer can be formed with the filter and the second passage connected to the first passage formed on the flat plate. Therefore, in comparison with a constitution of forming the filter by a separate member or forming the filter and the second passage on the other flat plates, a constitution of parts can be simplified and a number of fabricating steps can be reduced.

BRIEF DESCRIPTION OF THE DRAWINGS

Other and further objects, features and advantages of the invention will appear more fully from the following description taken in connection with the accompanying drawings in which.

DETAILED DESCRIPTION OF PREFERRED EMBODIMENTS

Ink-jet Recording Apparatus

Figure 1:
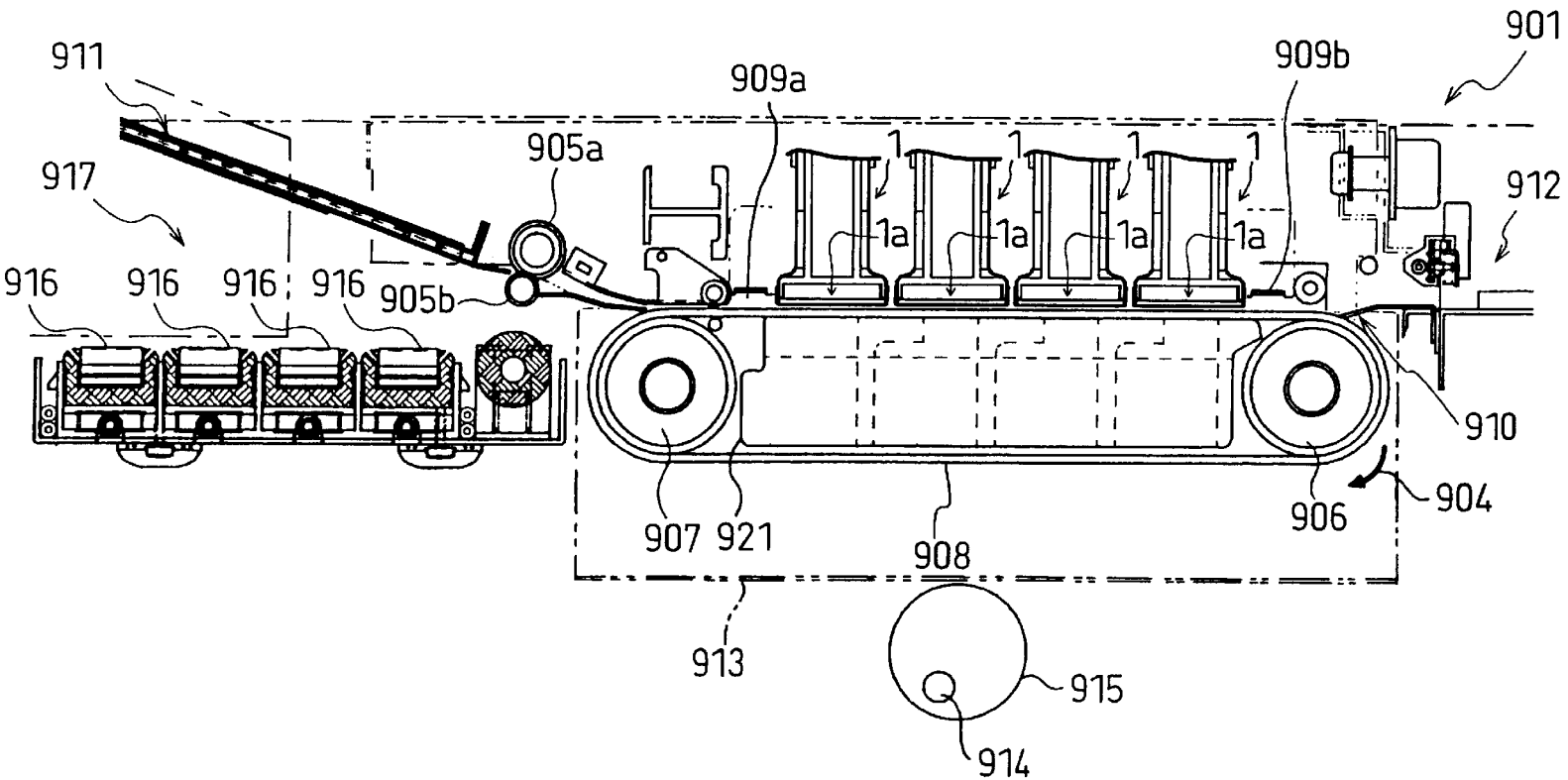
FIG. 1 is an outline view of an ink-jet printer including an ink-jet head according to an embodiment of the invention.

FIG. 1 is an outline view of an ink-jet printer including an ink-jet head according to an embodiment of the invention. An ink-jet printer 901 shown in FIG. 1 is a color ink-jet printer having four ink-jet heads 1. The ink-jet printer 901 respectively comprises a sheet feed portion 911 on the left side of the drawing and a sheet discharge portion 912 on the right side of the drawing.

A sheet transfer passage transferring sheet from the sheets feed portion 911 to the sheet discharge portion 912 is formed in the inside of the ink-jet printer 901. A pair of feed rollers 905*a*, 905*b*, pinching a sheet to transfer the sheet which is an image recording medium are arranged immediately downstream from the sheet feed portion 911. Sheets are transferred from the left side to the right side of the drawing by the pair of feed rollers 905*a*, 905*b*. Two belt rollers 906, 907 and an endless transfer belt 908 made to wrap around the two belt rollers 906, 907 to span therebetween are arranged at a middle portion of the sheet transfer passage. An outer peripheral face, that is, a transfer face of the transfer belt 908 is subjected to silicone treatment to thereby transfer sheets transferred by the pair of feed rollers 905*a*, 905*b* to the downstream side (right side) by driving rotation of one of the belt roller 906 in the clockwise direction of the drawing (in the direction shown by arrow 904) while holding the transfer sheet on the transfer face of the transfer belt 908 by adhering force thereof.

Hold members 909*a*, 909*b* are arranged at positions for inserting and discharging sheets in and from the belt roller 906 of the printer 901. The hold members 909*a*, 909*b* are for pushing the sheets to the transfer face of the transfer belt 908 to thereby firmly adhere onto the transfer face so that the sheets on the transfer belt 908 do not float up from the transfer face.

An exfoliating mechanism 910 is provided immediately downstream from the transfer belt 908 along the sheet transfer path. The exfoliating mechanism 910 is constituted to exfoliate the sheet adhered to the transfer face of the transfer belt 908 from the transfer face to transfer to the sheet to the sheet discharge portion 912 on the right side.

The four ink jet heads 1 each include a head main body 1*a* (constituted by pasting together an ink passage unit formed with an ink passage including a pressure chamber 20 and an actuator unit 30 for applying pressure to ink in the inside of the pressure chamber 20, as described later) at a lower end thereof. The head main bodies 1*a* are respectively provided with a rectangular section and are arranged proximately to each other so that a longitudinal direction thereof becomes a direction orthogonal to a direction of transferring the sheets (direction orthogonal to paper face of FIG. 1). That is, the ink-jet printer 901 is a line-type printer. Respective bottom faces of the four head main bodies 1*a* are opposed to the sheet transfer passage and the bottom faces are provided with a number of nozzles formed with ink ejecting ports having a small diameter. Inks of magenta, yellow, cyan, black are ejected from the four head main bodies 1*a* respectively.

The head main body 1*a* is arranged to form a small amount of clearance between a lower face thereof and the transfer face of the transfer belt 908 and the sheet transfer passage is formed in this clearance portion. According to this arrangement, when the sheet transferred on the transfer belt 908 is successively made to pass directly beneath the four head main bodies 1*a*, a desired color image can be formed on the sheet by injecting inks of respective colors from the nozzles to an upper face, that is, a print face of the sheet.

The ink-jet printer 901 includes a maintenance unit 917 for automatically carrying out maintenance for the ink-jet head 1. The maintenance unit 917 is provided with four caps 916 for covering lower faces of the four head main bodies la and a purge mechanism, which is not shown.

When printing is being carried out by the ink-jet printer 901, the maintenance unit 917 is disposed at a position directly beneath the sheet feed portion 911 (escaping position). Further, when a predetermined condition is satisfied after finishing the printing operation (for example, when a state in which the printing operation is not carried out continues for a predetermined time period or when an operation for turning OFF a power source of the printer 901 is carried out), the maintenance unit 917 moves to a position directly beneath the four head main bodies 1*a* and covers respective lower faces of the head main bodies 1*a* with the caps 916 to thereby prevent ink located at nozzle portions of the head main bodies 1*a* from becoming dried.

The belt rollers 906 and 907 and the transfer belt 908 are supported by a chassis 913. The chassis 913 is mounted on a cylindrical member 915 arranged thereunder. The cylindrical member 915 is made rotatable centering on a shaft 914 attached at a position deviated from a center thereof. Therefore, when a height of an upper end of the cylindrical member 915 is changed by rotating the shaft 914, the chassis 913 is lifted and lowered in accordance therewith. When the maintenance unit 917 is moved from the escaping position to the cap position, it is necessary to ensure a space for moving the maintenance unit 917 by previously rotating the cylindrical member 915 by a suitable angle and lowering the chassis 913, the transfer belt 908 and the belt rollers 906 and 907 from a position shown in FIG. 1 by a suitable distance.

Inside of a region surrounded by the transfer belt 908 is arranged with a guide 921 substantially in a shape of rectangular parallel pipe (having a width substantially the same as that of the transfer belt 908) for supporting the transfer belt 908 from an inner peripheral side thereof at a position opposed to the ink-jet heads 1, that is, by being brought into contact with a lower face of the transfer belt 908 disposed on the upper side.

Figure 2:
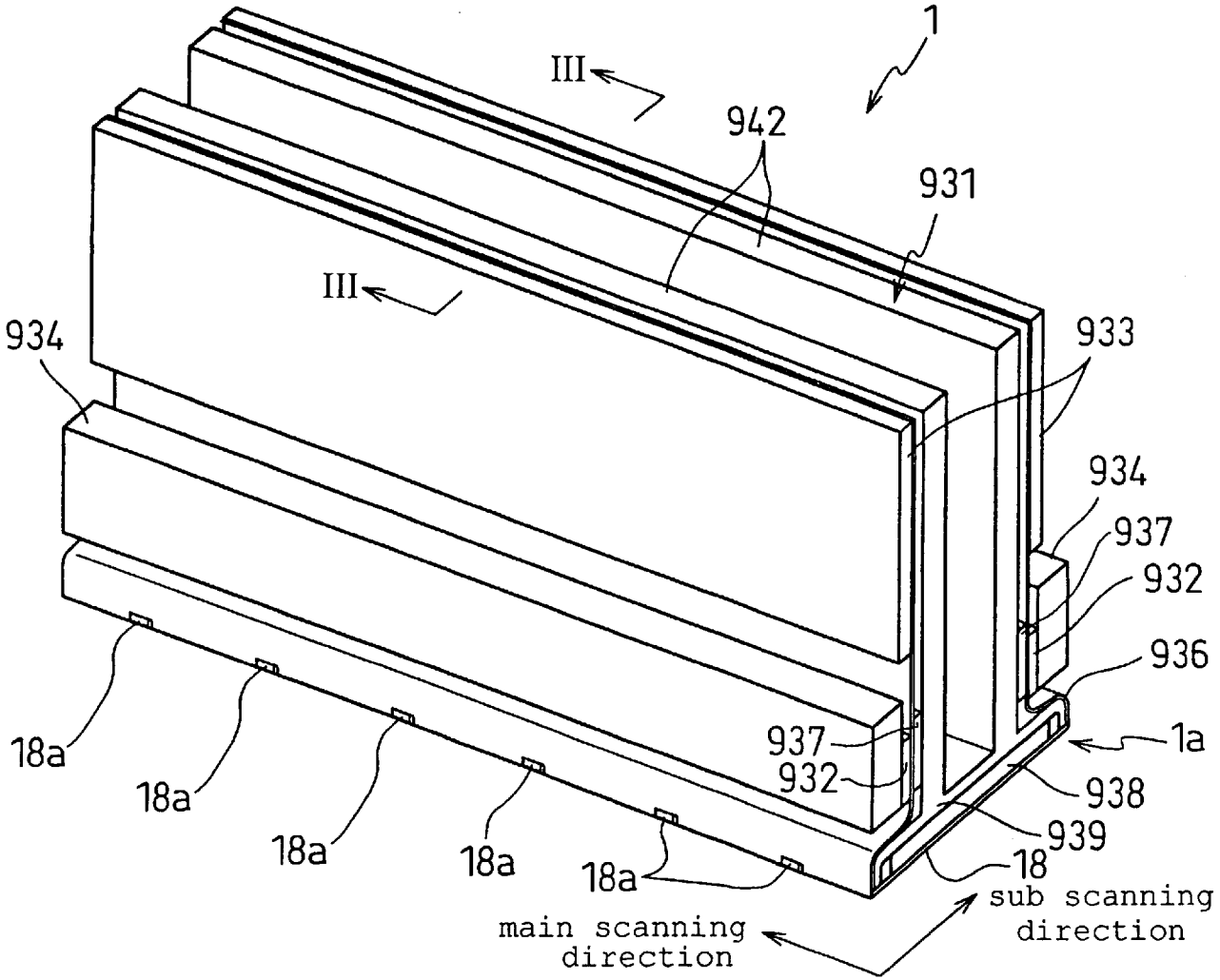
FIG. 2 is a perspective view of an ink-jet head.
Figure 3:
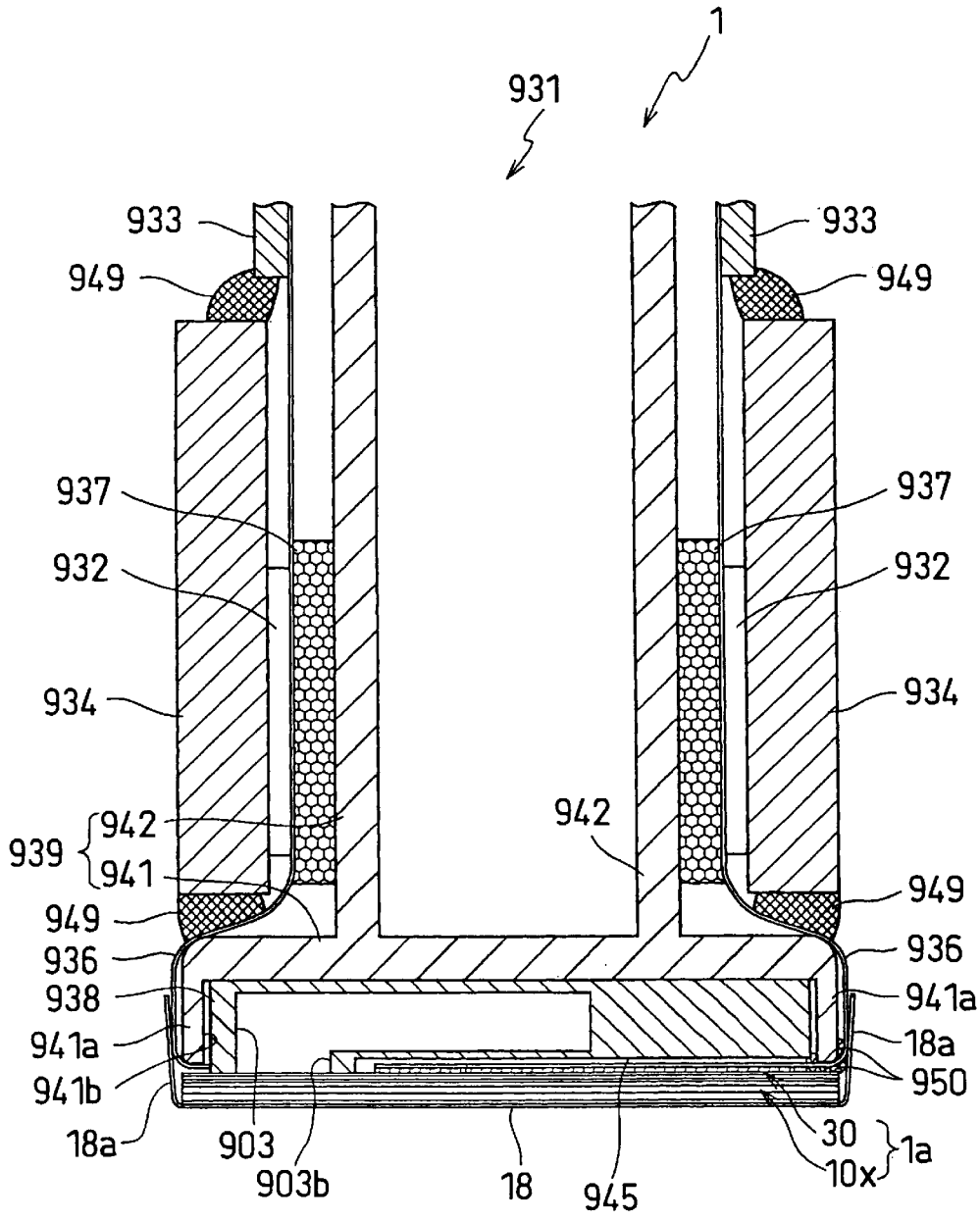
FIG. 3 is a sectional view taken along the line III—III of FIG. 2.

Next, a structure of the ink-jet head 1 according to the embodiment will be explained in further detail. FIG. 2 is a perspective view of the ink jet head 1. FIG. 3 is a sectional view taken along the line III—III of FIG. 2. As shown by FIGS. 2 and 3, the ink-jet head 1 according to the embodiment includes the head main body 1*a* having a rectangular planer shape extended in one direction (main scanning direction) and a base portion 931 for supporting the head main body 1*a*. The base portion 931 supports a driver IC 932 for supplying drive signals to individual electrodes, as referred below, or the like and a substrate 933 other than the head main body 1*a*.

As shown by FIG. 2 and FIG. 3, the base portion 931 is constituted by a base block 938 for supporting the head main body 1*a* by being partially adhered to an upper face of the head main body 1*a* and a holder 939 for holding the base block 938 by being adhered to an upper face of the base block 938. The base block 938 is a member in a shape of substantially a rectangular parallel pipe having a length substantially the same as a length of the head main body 1*a* in a longitudinal direction. The base block 938 comprising a metal material of stainless steel or the like functions as a light-weighted structure reinforcing the holder 939. The holder 939 is constituted by a holder main body 941 arranged on a side of the head main body 1*a* and a pair of holder support portions 942 extended from the holder main body 941 to a side opposed to the head main body 1*a*. Each holder support portion 942 has a flat plate shape and is spaced apart from the other holder support 942 by a predetermined interval and in parallel with the other along a longitudinal direction of the holder main body 941.

A pair of skirt portions 941*a* projected downwardly are provided at both end portions in a sub scanning direction (direction orthogonal to main scanning direction) of the holder main body 941. Here, each skirt portion 941*a* is formed over a total width in the longitudinal direction of the holder main body 941 and therefore, a groove portion 941*b* in a shape of a substantially a rectangular parallel pipe is formed by the pair of skirt portions 941*a*. The base block 938 is contained in the inside of the groove portion 941*b*. An upper face of the base block 938 and a bottom face of the groove portion 941*b* of the holder main body 941 are adhered by an adhering agent. A thickness of the base block 938 is more or less larger than a depth of the groove portion 941*b* of the holder main body 941 and therefore, as shown by FIG. 3, a lower end portion of the base block 938 is projected downwardly from the skirt portion 941*a*.

Inside of the base block 938 is formed an ink storage 903 which is a space (hollow region) in a shape of substantially a rectangular parallel pipe extended in a longitudinal direction thereof as a flow passage of ink supplied to the head main body 1*a*. A lower face 945 of the base block 938 is formed with an opening 903*b* communicating with the ink storage 903. Further, the ink storage 903 is connected to a main ink tank (ink supply source), not shown, in the inside of a printer main body by a supply tube, which is not shown. Therefore, the ink storage 903 is suitably replenished with ink from the main tank.

The lower face 945 of the base block 938 projects downwardly in an area directly surrounding the opening 903*b*. Further, the base block 938, is brought into contact with a flow passage unit (a set of cavity plates 10*x*, as referred below) only in the vicinity of the opening 903*b* (see FIG. 3). Therefore, a region of the base block 938, other than in the vicinity of the opening 903*b* of the lower face 945, is separated from the head main body 1*a*, and the actuator unit 30 is arranged in the separated portion.

The driver IC 932 is fixed to an outer side face of the holder support portions 942 of the holder 939 via an elastic member 937 of sponge or the like. A heat sink 934 is arranged to be brought into close contact with an outer side face of the driver IC 932. The heat sink 934 is a member in a shape of substantially a rectangular parallel pipe for efficiently dispersing heat generated in the driver IC 932. The driver IC 932 is connected with a flexible printed circuit (FPC) 936 which is an electricity feeling member. FPC 936 connected to the driver IC 932 is electrically bonded to the substrate 933 and the head main body 1*a* by soldering. The substrate 933 is arranged above the driver IC 932 and the heat sink 934 and outside of the FPC 936. An interval between an upper face of the heat sink 934 and the substrate 933 and an interval between a lower face of the heat sink 934 and FPC 936 are adhered respectively by a seal member 949.

A seal member 950 is arranged between a lower face of the skirt portion 941*a* of the holder main body 941 and an upper face of the flow passage unit 10*x* to interpose FPC 936. That is, FPC 936 is fixed to the flow passage unit 10*x* and the holder main body 941 by the seal member 950. Thereby, bending of the head main body 1*a* when elongated can be prevented, stresses are prevented from being applied to a portion connecting the actuator unit 30 and FPC 936, and FPC 936 can firmly be held.

A shown in FIG. 2, six projected portions 18*a* are arranged to be spaced apart from each other uniformly along a side wall of the ink-jet head 1. The projected portions 18*a* are portions provided at both end portions in the sub scanning direction of a nozzle plate (eighth flat plate, as referred below) 18 which is a lowermost layer of the head main body 1*a*. That is, as shown in FIG. 3, the nozzle plate 18 is folded to bend by about 90 degrees along a boundary line of the projected portion 18*a* and the other portion. The projected portions 18*a* are provided at positions in correspondence with vicinities of both end portions of sheets of various sizes used for printing in the ink-jet printer 901. The bent portions of the nozzle plate 18 are constituted not by right angles but by rounded shapes. Therefore, clogging of sheets brought about by bringing a front end of a sheet transferred in a direction approaching the inkjet head 1 into contact with a side face of the ink-jet head 1 is prevented. That is, jamming of the sheets in the ink-jet printer 901 is prevented.

First Embodiment

Figure 4:
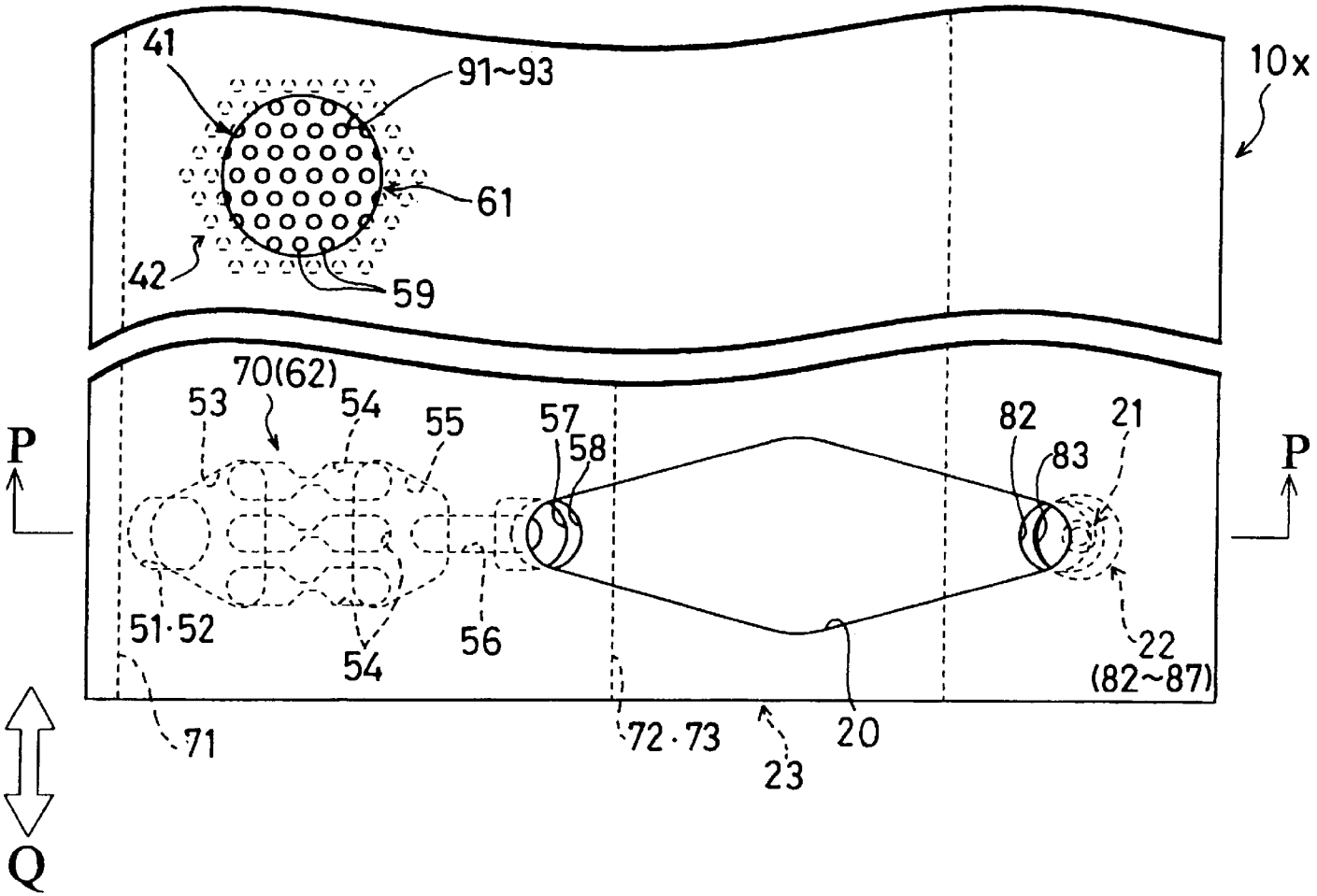
FIG. 4 is a plane view of an ink-jet head according to a first embodiment of the invention.
Figure 5:
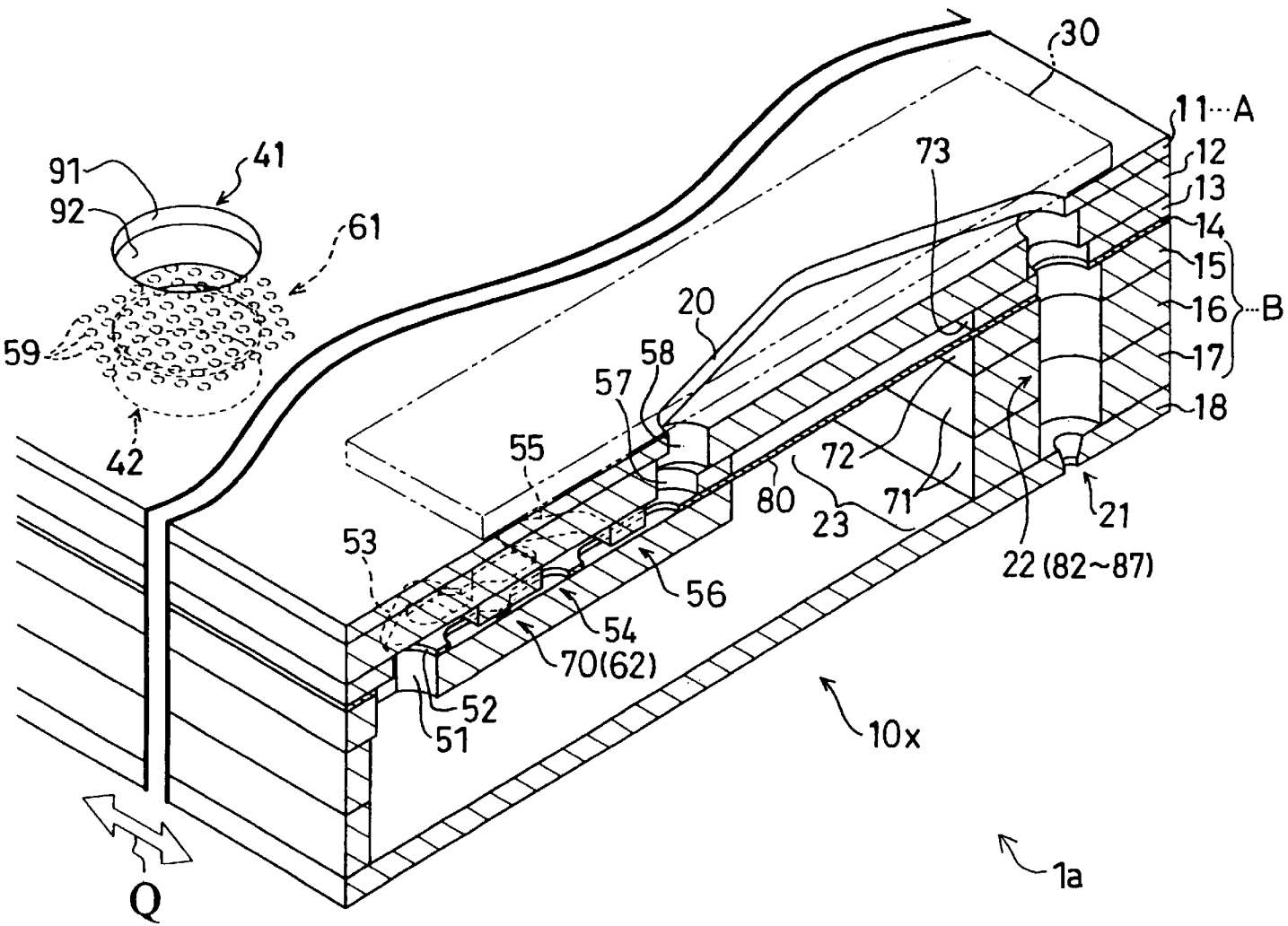
FIG. 5 is a perspective view of the ink-jet head showing a section taken along the line P—P of FIG. 4.

The head main body la of the ink-jet head includes a set of cavity plates 10*x* constituting the above-mentioned ink passage unit shown in FIG. 4 and the actuator unit 30 fixed to an upper face thereof as shown in FIG. 5.

The set of cavity plates 10*x* is formed with an ink supply port 41 for supplying ink from an ink tank (ink supply source), not shown, opened on an upper face thereof. The ink supply port 41 is connected to a common ink chamber 23 formed in the inside of the set of cavity plates 10*x* via an ink supply passage 42. A first filter 61 is provided in the intermediate portion of the ink supply passage 42.

The ink supply port 41 is disposed aligned to the position of opening 903*b* (as shown in FIG. 3) formed on the lower face 945 of the base block 938. Thereby, ink in the inside of the ink storage 903 is suitably supplied to the ink supply port 41.

The pressure chamber 20 is in a rhombic shape and is recessed on the upper face of the set of cavity plates 10*x*. Although only a single one of the pressure chamber 20 is representatively shown in the drawing, actually, a number of components thereof are provided to align the pressure chamber in a longitudinal direction of the common ink chamber 23 (Q direction shown in FIG. 3, FIG. 4). Each of the pressure chambers 20 is communicated with the common ink chamber 23 via a trap filter 70 and a flow path control means 56, mentioned later.

A nozzle 21 for injecting ink drops is opened on a lower face of the set of cavity plates 10*x* respectively in correspondence with the pressure chamber 20. The corresponding pressure chamber 20 and the nozzle 21 are communicated via a connection passage 22.

Substantially shown in FIG. 5 by chain lines, the actuator unit 30 is in a flat plate shape and is adhered to the upper face of the set of cavity plates. The actuator unit 30 is provided to close upper sides of the pluralities of pressure chambers 20 provided in a row.

The actuator unit 30 is similar to that disclosed in JP-A-3-274159. That is, piezoelectric ceramics layers and electrodes are alternately laminated and at least one of the electrodes interposing the piezoelectric ceramics layer (individual electrode) is constituted in a planar shape substantially similar to and more or less smaller than a planar shape of the pressure chamber 20. The individual electrode is electrically connected to the driver IC 932 via the FPC 936 and voltage can be applied across two of the electrodes interposing the piezoelectric ceramics layer. By voltage applied in this way, a portion of the piezoelectric ceramics layer corresponding to the pressure chamber 20 is deformed to thereby apply pressure to ink located inside of the pressure chamber 20 so ink can be injected from the nozzle 21.

However, a constitution in which injection pressure is applied to ink by utilizing force created by static electricity, magnetism, local boiling of ink by heat or the like, other than the piezoelectric or electrostrictive deformation, can also be used for the actuator unit 30.

Figure 6:
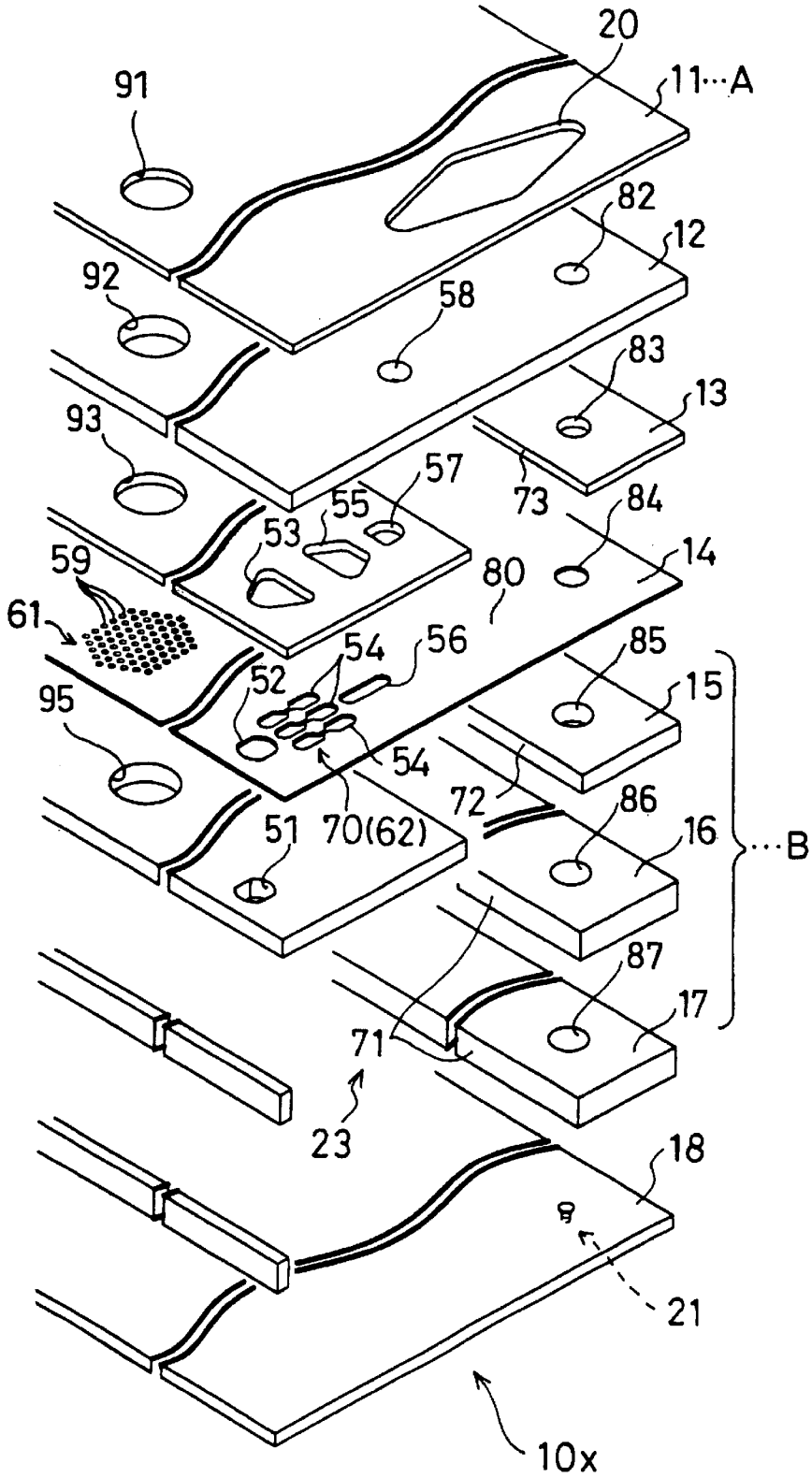
FIG. 6 is a disassembled perspective view showing a laminated structure of a set of cavity plates.

As shown by FIG. 5, the set of cavity plates 10*x* is constituted with eight thin flat plates 11 to 18 in a lamination structure that adheres to each other. FIG. 6 is a broken perspective view showing the lamination structure of the set of cavity plates 10*x*.

Further, in the following, for convenience of explanation of the constitution, when each of the flat plates 11 through 18 is specified, each of the flat plates 11 through 18 is referred to as an "n-th flat plate" by numbering the flat plates from a side remote from the nozzle 21. The flat plate 11 shown at the uppermost side in the drawing is referred to as a first flat plate, the flat plate 18 shown at the lowermost side is referred to as an eighth flat plate. Further, according to the description of the first embodiment, attention is paid to the fourth flat plate 14 and the fourth flat plate 14 may be referred to as the "flat plate member".

According to the first embodiment, all of the flat plates 11 through 18 except the fourth flat plate 14 (flat plate member) are made of a metal. The fourth flat plate 14 comprises polyimide.

As shown by FIG. 5, the plurality of pressure chambers 20 are formed in the first flat plate 11 by etching. In the eighth flat plate 18, the nozzle 21 corresponding to each of the pressure chambers 20 is bored by pressing.

As shown in FIG. 6, the second through the seventh flat plates 12 through 17 are respectively provided with through holes 82 through 87 in a penetrated shape. The respective through holes 82 through 87 are connected to each other when the first through the eighth flat plates 11 through 18 are laminated to thereby form the connection passage 22 connecting the pressure chamber 20 and the nozzle as shown in FIG. 5.

A constitution of the common ink chamber 23 will be explained. The sixth and the seventh flat plates 16 and 17 are respectively etched to form a first space 71. Further, the fifth flat plate 15 located directly above the sixth flat plate 16 is also etched to form a second space 72 with narrower height in the laminating direction than that of the first space 71.

By laminating the fifth through the seventh flat plates 15, 16 and 17, the first space 71 and the second space 72 are bonded to constitute the common ink chamber 23.

According to the embodiment, as described above, the first flat plate 11 is formed with the pressure chamber 20 and therefore, the first flat plate 11 corresponds to a pressure chamber forming layer (hereinafter, referred to as "first flat plate layer") A. Further, since the fifth through the seventh flat plates 15, 16 and 17 form the common ink chamber 23, the fifth through the seventh flat plates 15, 16 and 17 correspond to a common ink chamber forming layer (hereinafter, referred to as second flat plate layer) B.

The fourth flat plate 14 serving as the flat plate member is disposed between the first flat plate layer A and the second flat plate layer B.

According to the first embodiment, a damper structure for absorbing pressure variation of the common ink chamber 23 is provided in the fourth flat plate 14 (flat plate member). That is, the second space 72 constituting the common ink chamber 23 is bored on the fifth flat plate 15 in the penetrated shape and therefore, the common ink chamber 23 faces the fourth flat plate 14 constituting the flat plate member on a lower side thereof. Further, also the third flat plate 13 facing the flat plate member 14 on a side opposed to the common ink chamber 23 (side remote from the nozzle 21) is etched to form a space 73 of a shape in correspondence with the second space 72.

The flat plate member 14 comprises a suitably elastic material and by forming the space 73, the flat plate member 14 can be freely vibrated to the side of the common ink chamber 23 as well as to the side of the space 73.

As a result, even when pressure variation generated in the pressure chamber 20 in injecting ink is propagated to the common ink chamber 23, the pressure variation can be absorbed to attenuate by vibrating the flat plate member 14 by elastic deformation (damper operation) and cross talk in which the pressure variation is propagated to other pressure chambers 20 can be prevented. That is, the space 73 serves as a damper chamber, and the flat plate member 14 constitutes at least some part of a wall portion (damper portion 80) in the damper chamber.

Next, an ink flow passage between the common ink chamber 23 and the pressure chamber 20 will be explained.

Guide holes 51 and 52 for guiding ink from the common ink chamber 23 to the pressure chamber 20 are bored in the fifth flat plate 15 and the flat plate member 14.

In the third flat plate 13, a filter connection hole 53 one end of which is connected to the guide holes 51 and 52 is bored. This filter connection hole 53 is formed substantially in a triangular shape and connected to the trap filter 70 bored to the fourth flat plate (flat plate member) 14.

As shown in FIG. 4 and FIG. 6, the trap filter 70 is formed with three pieces of slender flow passages 54 in a row. The respective flow passages 54 are formed by boring slender holes in a penetrated shape on the flat plate member 14 and one side end of the respective flow passages 54 are connected to the filter connection hole 53. As shown in FIG. 4, intermediate portion of each of the flow passages 54 is narrowed particularly slenderly and an impurity in ink can be caught by the throttle member.

The trap filter 70 is a filter of a type of filtering ink by making ink flow in a face direction in the inside of the flat plate member 14.

Here, the flat plate member 14 is constituted to be thin relative to the other flat plates (11 through 13, 15 through 18), particularly, a thickness of the flat plate member 14 is made to be smaller than a diameter of the nozzle 21. Therefore, dust and dirt or an impurity having a size of clogging the nozzle 21 are necessarily caught by the throttling member of the filter 70 formed on the flat plate member 14 in the ink flow passage before reaching the nozzle 21. Therefore, clogging of the nozzle 21 is avoided and therefore, an inkjet head which prevents trouble in printing quality of omission of dots or the like can be provided.

All of the other ends of three pieces of the flow passages 54 of the trap filter 70 are connected to a flow path control means connection hole 55 bored on the third flat plate 13. The flow path control means connection hole 55 is further connected to the flow path control means 56 bored on the fourth flat plate (flat plate member) 14.

The flow path control means 56 is constituted by a long hole provided in a penetrated shape at a position immediately at a side of the trap filter 70 and serves to suitably control an injection amount of the ink from the nozzle 21 by controlling a supply amount of the ink to the pressure chamber 20 by controlling a flow rate of ink passing through the flow path control means 56 between the third and the fifth flat plates 13 and 15.

The flow path control means 56 is provided on the fourth flat plate 14 and the fourth flat plate (flat plat member) 14 is a flat plate having a height different from those of the first flat plate 11 forming the pressure chamber 20 and the fifth through the seventh flat plates 15 through 17 forming the common ink chamber 23. As a result, the flow path control means 56 is provided at the height different from those of the pressure chamber 20 and the common ink chamber 23 in the laminating direction of the flat plates.

Further, as shown in FIG. 5, the flow path control means 56 is located directly above, in the direction of lamination of the flat plate 11 to 18, the common ink chamber 23.

This allows for a layout of compact arrangement of the common ink chamber 23, the flow path control means 56, and the pressure chamber 20 in a limited space. Therefore, the layout is adapted for compact formation of the ink-jet head 1 and for dense arrangement of the pressure chamber 20 and the flow path control means 56 based on high resolution formation.

The other end of the flow path control means 56 is connected to an end portion of the pressure chamber 20 via through holes 57 and 58 provided on the third flat plate 13 and the second flat plate 12, respectively.

Here a cross-sectional area of the flow path control means 56 directly influences on an amount of supplying ink to the pressure chamber 20 (refill amount) and the injection amount of ink from the nozzle 21 in the end. Therefore, it is extremely important to accurately form dimensions and a shape of the flow path control means 56 with excellent precision in order to prevent excess or deficiency of the ink injection amount from the nozzle 21.

In this respect, when the flow path control means 56 is constituted by grooving one of the laminated flat plates by half etching, a rate of etching is liable to be influenced by various conditions of temperature, concentration and the like of an etching solution. Therefore, a dispersion is liable to be caused in a depth of half etching and it is extremely difficult to accurately form the dimensions of the flow path control means 56.

In view of the above-described situation, according to the embodiment, the fourth flat plate (flat plate member) 14 is formed by polyimide in thin layer and the flow path control means 56 is formed by opening a hole in a penetrated shape by laser machining while using a mask made of a metal film. As a result, the shape and the size of the flow path control means 56 can be accurately formed, a dispersion in flow passage resistance of the flow path control means 56 is eliminated and the printing quality is improved.

By the above-described constitution, ink inside of the common ink chamber 23 reaches the inside of the flat plate member 14 (trap filter 70) from the guide holes 51 and 52 via the filter connection hole 53 and the ink is filtered at the trap filter 70 by flowing in the face direction of the flat plate member 14 to remove the impurity. Further, ink reaches the flow path control means 56 via the flow path control means connection hole 55 and is supplied to the pressure chamber 20 via the through holes 57 and 58. That is, according to the embodiment disclosed in FIG. 4 through FIG. 6, the trap filter 70 corresponds to the second filter 62 for filtering ink directed from the common ink chamber 23 to the pressure chamber 20. By presence of the trap filter 70, dust and dirt and an impurity in the ink of the common ink chamber 23 can be removed before reaching the pressure chamber 20.

Next, the constitution of the ink supply passage 42 for supplying ink from an outside ink supply source to the common ink chamber 23 will be explained.

As shown in FIG. 6, the fifth flat plate 15 is bored with a supply hole 95 to connect to the common ink chamber 23. The fourth flat plate (flat plate member) 14 right thereabove is bored with a number of filter holes 59 in a row at a position in correspondence with the supply hole 95 to constitute the first filter 61.

The first through the third flat plates 11 through 13 are respectively formed with connection holes 91 through 93 so as to be aligned to the first filter 61. By the supply hole 95 and the connection holes 91 through 93, the ink supply passage 42 for supplying ink from outside to the common ink chamber 23 is constituted. According to the constitution, by presence of the first filter 61, dust and dirt and an impurity in the ink of the ink supply passage 42 can be removed.

As is apparent from FIG. 6, according to the embodiment, the flow path control means 56 is formed on the fourth flat plate (flat plate member) 14, former, also the damper portion 80 for absorbing the pressure variation of the common ink chamber 23 is formed on the flat plate member 14. Therefore, the constitution is simplified in comparison with a case in which the flow path control means 56 and the damper portion 80 are provided on separate flat plates, further, both of the flow path control means 56 and the damper portion 80 can be simultaneously fabricated as part of the flat plate member 14 and therefore, fabricating steps can be simplified and fabrication cost can be reduced.

Further, according to the embodiment, filters 61 and 70 for filtering ink are formed on the flat plate member 14. With this constitution, the flow path control means 56 and the damper as well as the filters 61 and 70 can be simultaneously fabricated as part of the flat plate member 14 and the fabricating steps are further simplified.

Further, in this way, the flat plate member 14 is provided with the filter (trap filter 70) for making ink flow in the face direction to filter ink and the filter (first filter 61) for making ink flow in the thickness direction to filter ink. Therefore, a degree of freedom of arranging flow passages using filters is high and compact formation, high integrated formation of flow passages and small-sized formation of the ink-jet head are also facilitated.

Further, the space 73 formed on the third flat plate 13 above the flat plate member 14 is filled with air and the flat plate member 14 is made of polyimide and thinly constituted. Therefore, air in the space 73 permeates the portion of the flat plate member 14 to thereby produce air bubbles on the side of the common ink chamber 23 filled with ink.

Figure 7:
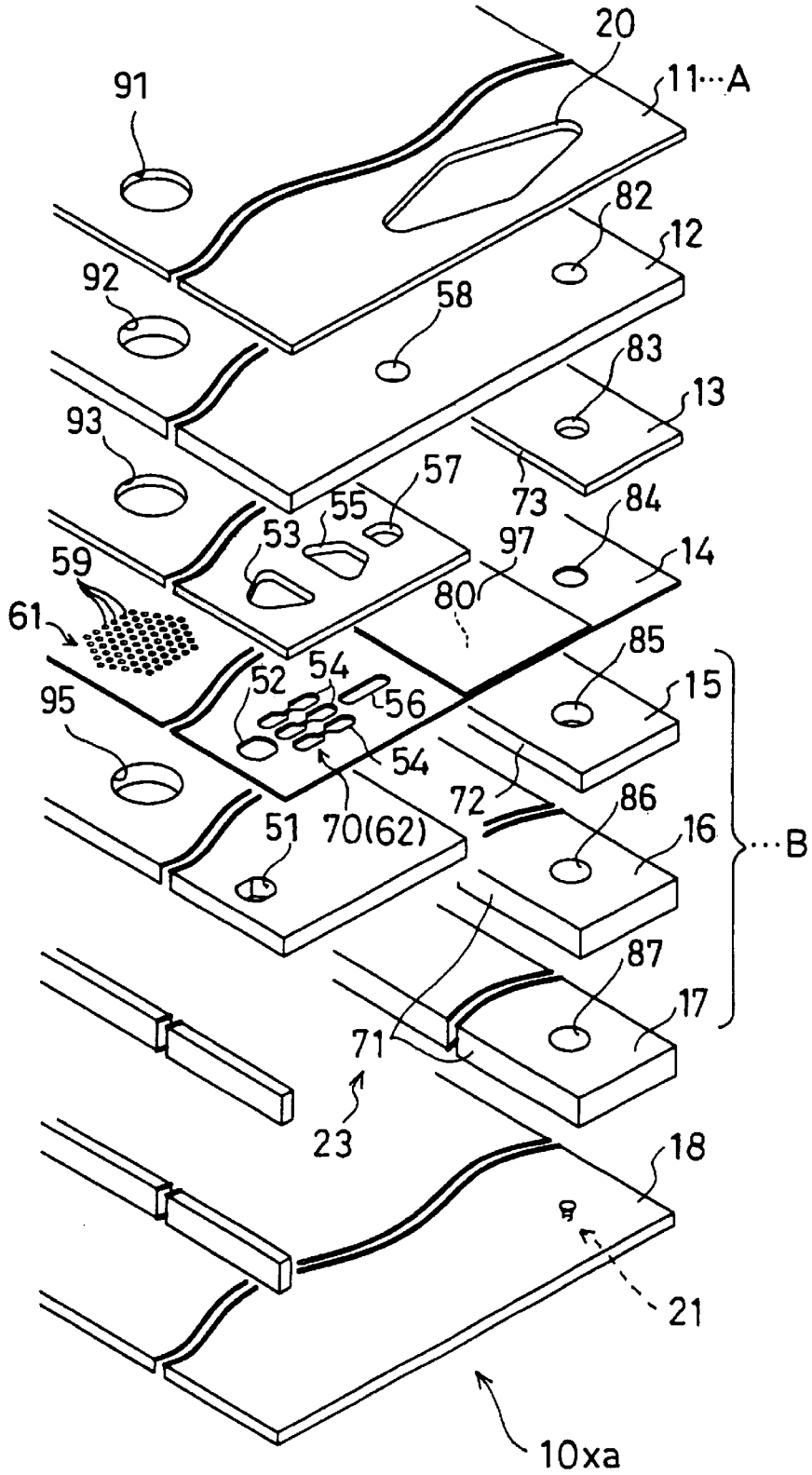
FIG. 7 is a disassembled perspective view an embodiment of a set of cavity plates wherein a flat plate member is formed with a metal film.

In order to overcome this problem, a modified example a of the first embodiment is disclosed in FIG. 7. In a set of cavity plates 10*xa* shown in FIG. 7, the flat plate member 14 is formed with a metal film 97 by vapor deposition or sputtering in at least a vibrating portion thereof (damper portion 80) to thereby prevent air from permeating the flat plate member 14. Although the metal film may be formed on a face of the damper chamber (space 73) side of the flat plate member 14 or may be formed on the side of the common ink chamber 23, it is preferable to form the metal film on the side of the damper chamber (space 73) in view of avoiding corrosion by ink or such as dissolution of a metal component to ink. Further, when the metal film 97 is formed simultaneously with the metal film of the pattern mask of laser machining in forming the flow path control means 56 and the filters 61 and 70, fabrication steps can be simplified.

That is, by making the flat plate member 14 by a resin, various methods of laser machining and the like can be adopted as a processing method for the flat plate member 14, and the metal film 97 can prevent air, inside the damper chamber and (space 73) passing through the damper part 80, from entering into the common ink chamber 23 and producing air bubbles.

Further, although according to the embodiment, the flat plate member 14 is made of polyimide, the members may be formed by epoxy resin or the like. Polyimide resin and epoxy resin are strong against the attack of ink and therefore, preferable as materials for forming the flow path control means 56 and the damper structure so durability of the ink-jet head 1 can be promoted. This signifies that a selectable range of ink types is enlarged.

Further, the material of the flat plate member 14 is not limited to resin but may be formed by, for example, metal. In this case, in order to carry out the damper operation, a suitably elastic metal is satisfactorily chosen. Further, when the flow path control means 56 and the filters 61 and 70 are formed on the flat plate member 14, the flow path control means 56 and the filters 61 and 70 may be formed in the penetrated shapes not by laser machining but by etching.

Further, in the above-described embodiment, the guide hole 52 formed in the flat plate member 14 may be replaced with a number of small through holes (similar to the filter holes 59), thereby, a filter can be constituted in place of guide hole 52. In this case, the filter replacing guide hole 52 may be used instead of the trap filter 70 or co-exist with the two filters 61 and 70 of the above embodiment (three filter formation).

Figure 8:
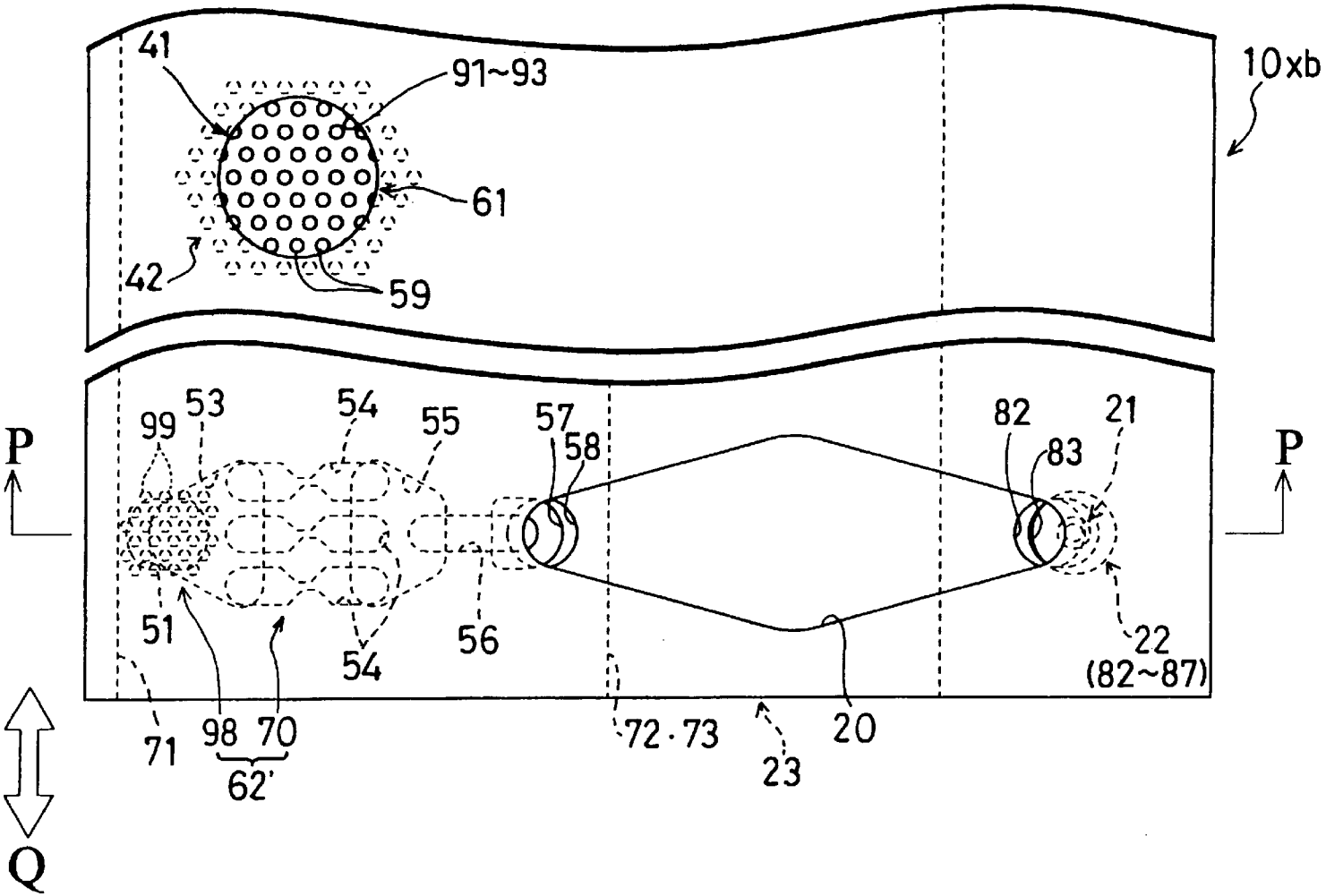
FIG. 8 is a plane view of an embodiment of an ink-jet head wherein a flat plate member is formed with an inner filter.
Figure 9:
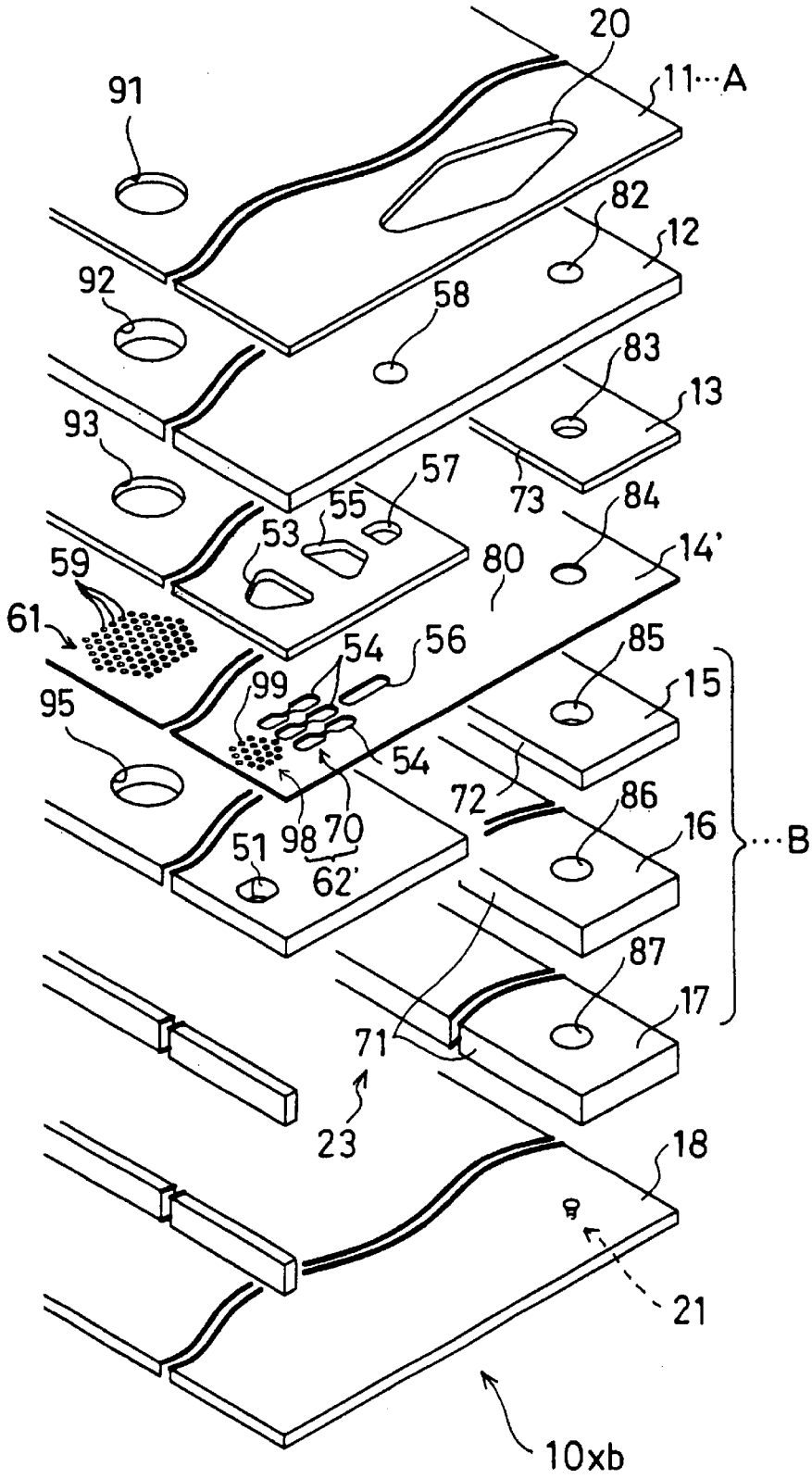
FIG. 9 is a disassembled perspective view showing an embodiment of the laminated structure of a set of cavity plates in an ink-jet head wherein a flat plate member is formed with an inner filter.

Three co-existed filter formation is shown in FIG. 8 and FIG. 9 as a modified example b of the first embodiment. According to a set of cavity plates 10*xb*, a number of fine through holes 99 are formed in place of the guide hole 52 on a flat plate member 14' to thereby form an inner filter 98. The first filter 61 and the three flow passages 54 (the trap filter 70) are provided quite similar to the above-described embodiment.

Therefore, ink directed from the common ink chamber 23 to the pressure chamber 20, is firstly filtered by passing the inner filter 98 in a thickness direction of the flat plate member 14' and thereafter filtered by passing the trap filter 70 constituted by three the flow passages 54 in the face direction of the flat plate member 14'. That is, according to the modified example b of the first embodiment, the second filter 62' for filtering ink directed from the common ink chamber 23 to the pressure chamber 20 comprises the inner filter 98 and the trap filter 70.

By providing three filters of the inner filter 98, the first filter 61 and the trap filter 70 in this way, dust and dirt and an impurity can be effectively prevented from reaching the pressure chamber 20 and the nozzle 21.

Further, since the flat plate member 14' is provided with the filter (trap filter 70) for making ink flow in the face direction to filter the ink and the filter (the first filter 61 and the inner filter 98) for making ink flow in the thickness direction to filter the ink in this way, the degree of freedom of arranging flow passages using the filters is high and compact formation and highly integrated formation of flow passages and small-sized formation of the ink-jet head are also facilitated.

Further, when the inner filter 98 in the guide hole 52 is used in place of the trap filter 70 as another embodiment, a new flow path control means is formed by forming only a single piece of the flow passage 54 (having a constitution which does not slenderly narrow a middle portion thereof) to connect to the flow path control means 56 and is realized by not forming the flow path control means connection hole 55.

Further, the first filter 61 or the trap filter 70 according to the embodiment may be formed on a flat plate different from the flat plate member 14 having the flow path control means 56 formed thereon. However, it is preferable to construct a constitution of providing both of the two filters 61 and 70 on the flat plate member 14 in view of further simplifying fabrication steps.

Second Embodiment

Next, a second embodiment will be explained. According to the second embodiment, constitutions of the flow path control means 56 and the filters 61 and 62 are more or less changed.

Figure 10:
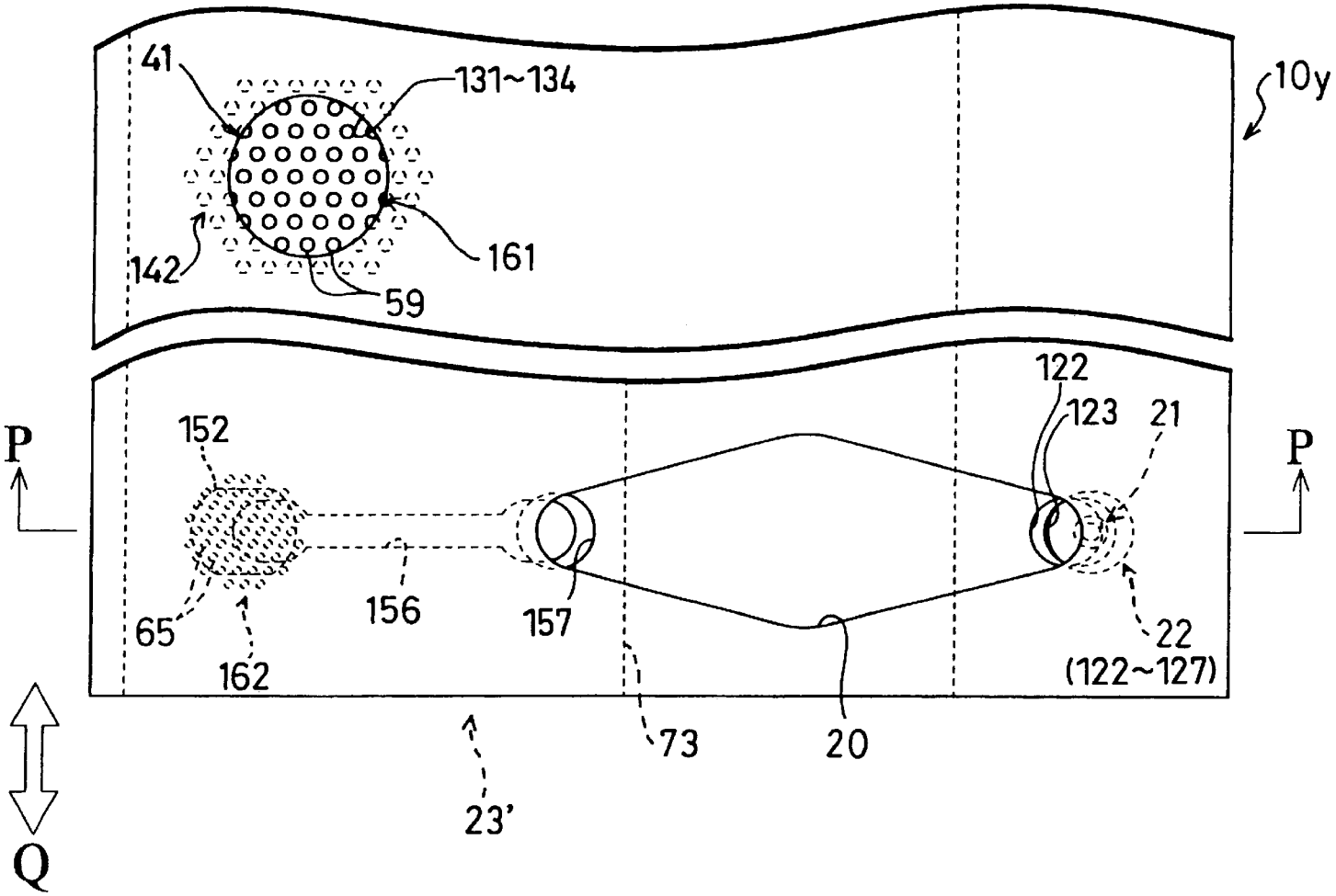
FIG. 10 is a plane view of an ink-jet head according to a second embodiment.
Figure 11:
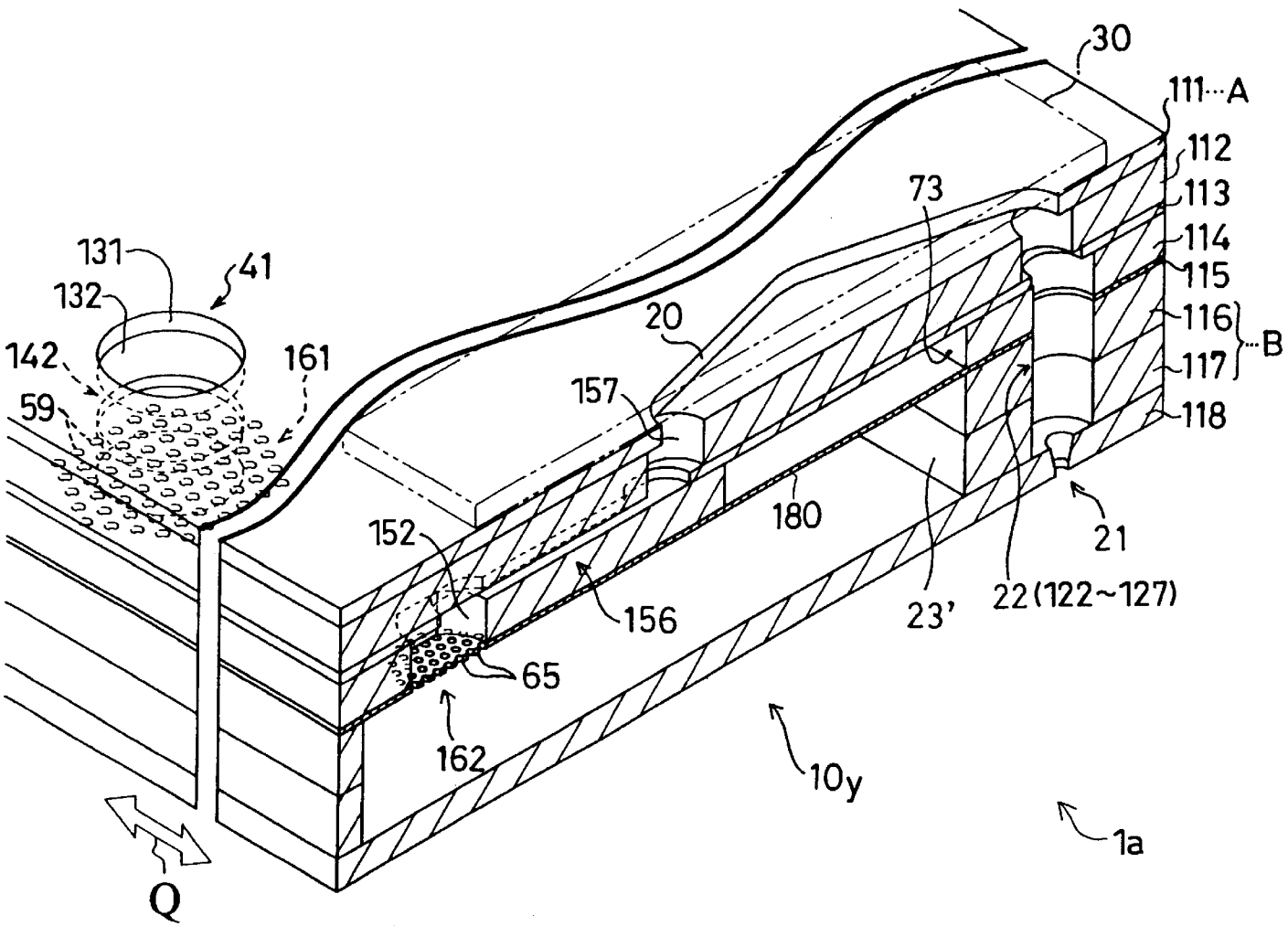
FIG. 11 is a perspective view of an ink-jet head showing a section taken along the line P—P of FIG. 10.

FIG. 10 is a plane view of an ink-jet head according to the second embodiment. FIG. 11 is a perspective view of the ink-jet head showing a section taken along the line P—P of FIG. 10.

Figure 12:
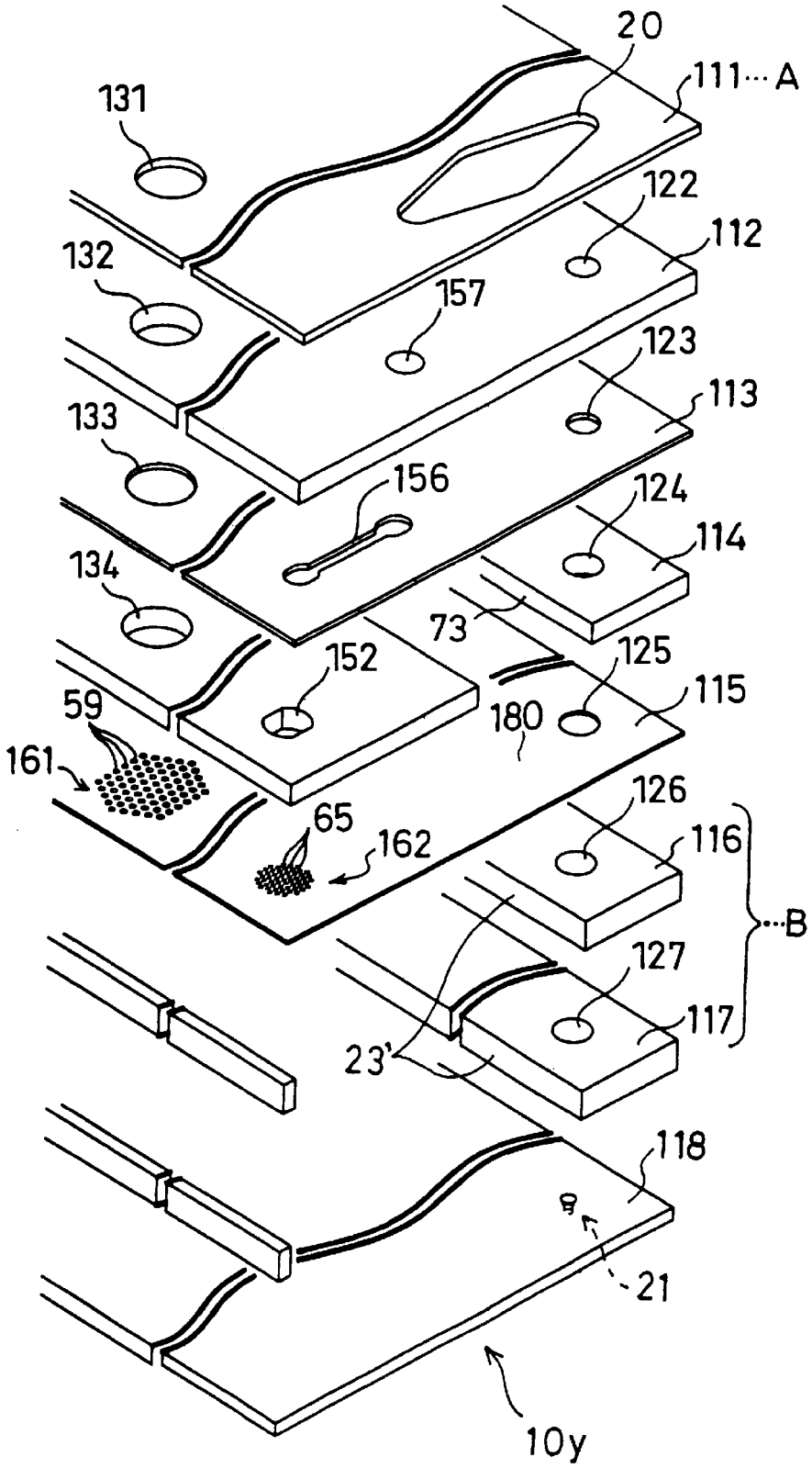
FIG. 12 is a disassembled perspective view showing a laminated structure of a set of cavity plates.

According to the head main body 1*a* of the ink-jet head of the second embodiment, as shown by FIG. 11, a set of cavity plates 10*y* is formed in the lamination structure of eight sheets of thin flat plates 111 to 118 to be adhered to each other. FIG. 12 shows a laminated structure of the set of cavity plates 10*y* in a disassembled perspective view.

Further, also according to the second embodiment, when each of the flat plates 111 through 118 is specified, each of the flat plates 111 through 118 is referred to as "n-th flat plate" by numbering the flat plates from a flat plate remote from the nozzle 21. In the description with regard to the second embodiment, attention is paid to the fifth flat plate 115 in the 8 sheets of the flat plates 111 through 118 and the fifth flat plate 115 may be referred to as "flat plate member".

According to the embodiment, all of the flat plates 111 through 118 are made of a metal except the fifth flat plate (flat plate member) 115. The fifth flat plate 115 comprises polyimide.

Similar to the first embodiment, the pressure chamber 20 is formed as a hole penetrating the first flat plate 111 in a rhombic shape and a number thereof are provided to align in the Q direction shown in FIG. 10 and FIG. 11. A common ink chamber 23' is provided by etching the sixth and the seventh flat plates 116 and 117 and formed to be long in the Q direction in which the pressure chambers 20 are aligned.

Therefore, according to the second embodiment, the first flat plate 111 corresponds to "first flat plate layer" A forming the pressure chamber 20. Further, the sixth and the seventh flat plates 116 and 117 correspond to "second flat plate layer" B forming the common ink chamber 23'. The fifth flat plate 115 constituting the flat plate member is disposed between the first flat plate layer A and the second flat plate layer B.

Nozzle 21 for injecting ink is opened on the eighth flat plate. The second through the seventh flat plates 112 through 117 are respectively provided with through holes 122 through 127 to form the connection passage 22 for connecting the pressure chamber 20 and the nozzle 21.

An explanation will be given to an ink flow passage reaching the pressure chamber 20 from the common ink chamber 23'.

The common ink chamber 23' is provided on the sixth and the seventh flat plates 116 and 117 as mentioned above and on the fifth flat plate (flat plat member) 115 located directly above the sixth flat plate 16, a number of filter holes 65 each having a small diameter are bored to align to constitute a second filter 162.

A guide hole 152 is opened on the fourth flat plate 114 so as to be aligned to the filter hole 65 of the second filter 162.

A flow path control means 156 in a shape of a long hole is formed to penetrate the third flat plate 113 and one end of the flow path control means 116 is connected to the guide hole 152. Similar to the flow path control means 56 according to the first embodiment, the flow path control means 156 is for adjusting an amount of ink supplied to the pressure chamber 20 by controlling a flow rate of ink passing the flow path control means 156. Further, a guide hole 157 for connecting the other end of the flow path control means 156 and the pressure chamber 20 is opened on the second flat plate 112.

According to this constitution, ink inside of the common ink chamber 23' is filtered by passing through the second filter 162 and reaches the guide hole 152. Further, ink is supplied to the pressure chamber 20 via the guide hole 157 while the flow rate is controlled by the flow path control means 156.

Next, an explanation will be given to a constitution of an ink supply passage 42' for supplying ink from an outside ink supply source to the common ink chamber 23'. As shown in FIG. 12, a first filter 161 for filtering ink is constituted by connecting to the common ink chamber 23' and boring to align a number of filter holes 59 on the fifth flat plate 115. Further, connection holes 131 through 134 are formed on the first through the fourth flat plates 111 through 114 by aligning to the first filter 161. When the flat plates 111 through 118 are laminated, the above-described ink flow passage 42' is formed by linearly connecting the connection holes 131 through 134.

In this way, both of the first filter 161 arranged at the ink supply passage 42' and the second filter 162 arranged at the ink flow passage between the common ink chamber 23' and the pressure chamber 20 are provided on the fifth flat plate (flat plate member) 115.

As a result, the two filters 161 and 162 can be formed on the flat plate member 115 in one operation and therefore, fabricating steps can be simplified. According to the embodiment, the filter holes 59, 65 of the two filters 161 and 162 are bored in one operation by subjecting the flat plate member 115 constituted by polyimide to laser machining by using a metal film mask formed with patterns of the filter holes 59 and 65 of the two filters.

The common ink chamber 23' is formed to face a lower side of the flat plate member 115. Further, a space 73 constituting a damper chamber is formed on the fourth flat plate 114 facing the flat plate member 115 on a side opposed to the common ink chamber 23' by etching and the flat plate member 115 can be elastically deformed to vibrate thereby forming a damper mechanism for similar operation to the first embodiment.

Figure 13:
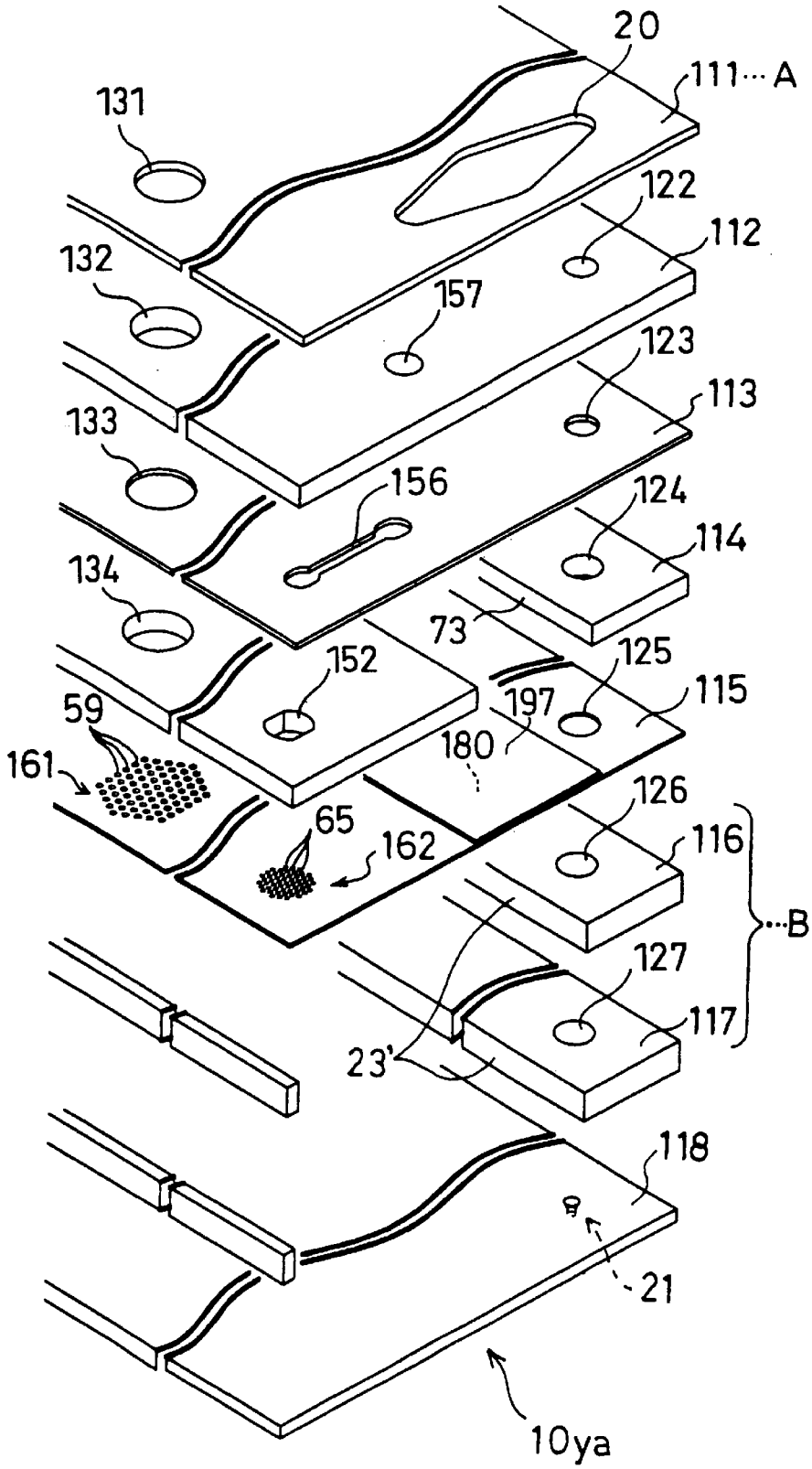
FIG. 13 is a disassembled perspective view of an embodiment of a set of cavity plates wherein a flat plate is formed with a metal film.

Further, similar to the first embodiment, a metal film 197 for preventing air from permeating may be formed by vapor deposition or sputtering on a portion of the flat plate member 115 corresponding to the space 73 (refer to a set of cavity plates 10*ya* as a modified example a of the second embodiment shown in FIG. 13). Although the metal film 197 may be formed on either face of the flat plate member 115, it is preferable to form the metal film 197 on a side of the damper chamber (space 73) as shown by FIG. 13 in view of avoiding a drawback of corrosion or dissolution produced by a chemical reaction with ink.

As has been explained above also in the second embodiment, the single flat plate member 115 is provided with both of the two filters 161 and 162 and the flat plate member 115 is constituted to carry out a damper operation and therefore, the constitution is further simplified and the fabrication is facilitated.

Third Embodiment

Next, a third embodiment of an ink-jet head will be explained in reference to FIG. 14 through FIG. 19.

Figure 14:
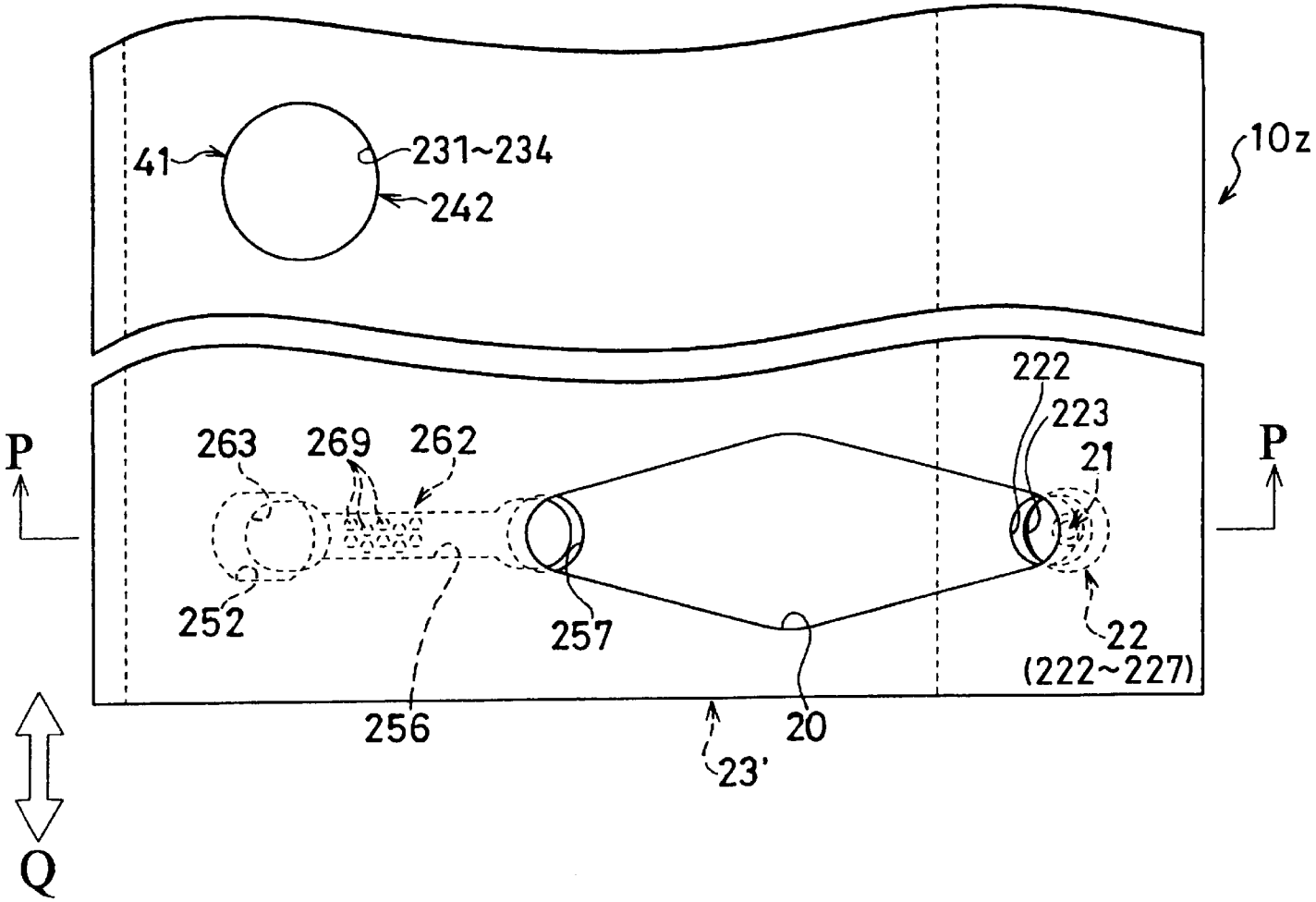
FIG. 14 is a plane view of an inkjet head according to a third embodiment.

FIG. 14 is a plane view of the ink-jet head according to the third embodiment.

Figure 15:
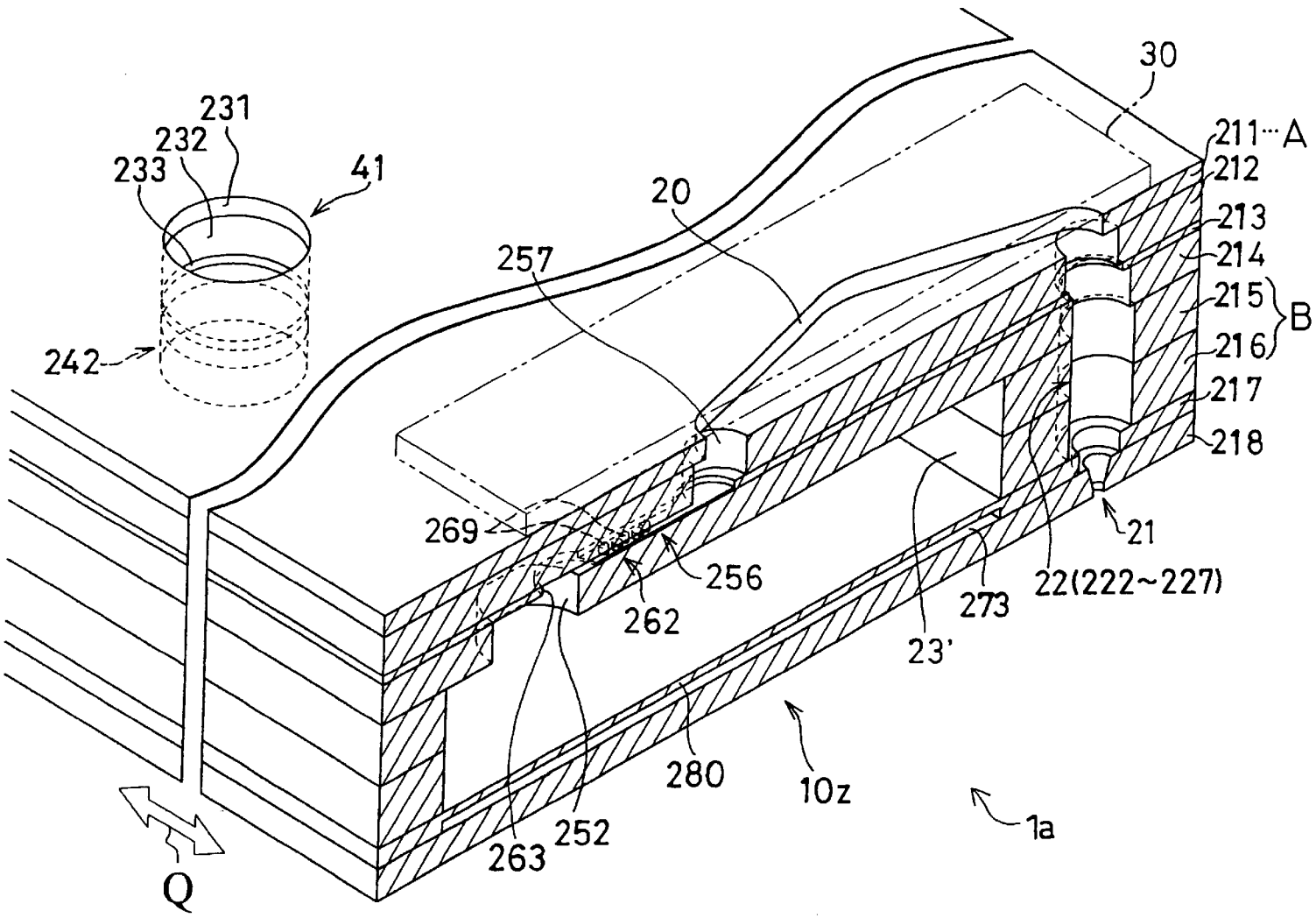
FIG. 15 is a perspective view of an ink-jet head showing a section taken along the line P—P in FIG. 14.

FIG. 15 is a perspective view of the ink-jet head showing a section taken along the line P—P in FIG. 14.

Figure 16:
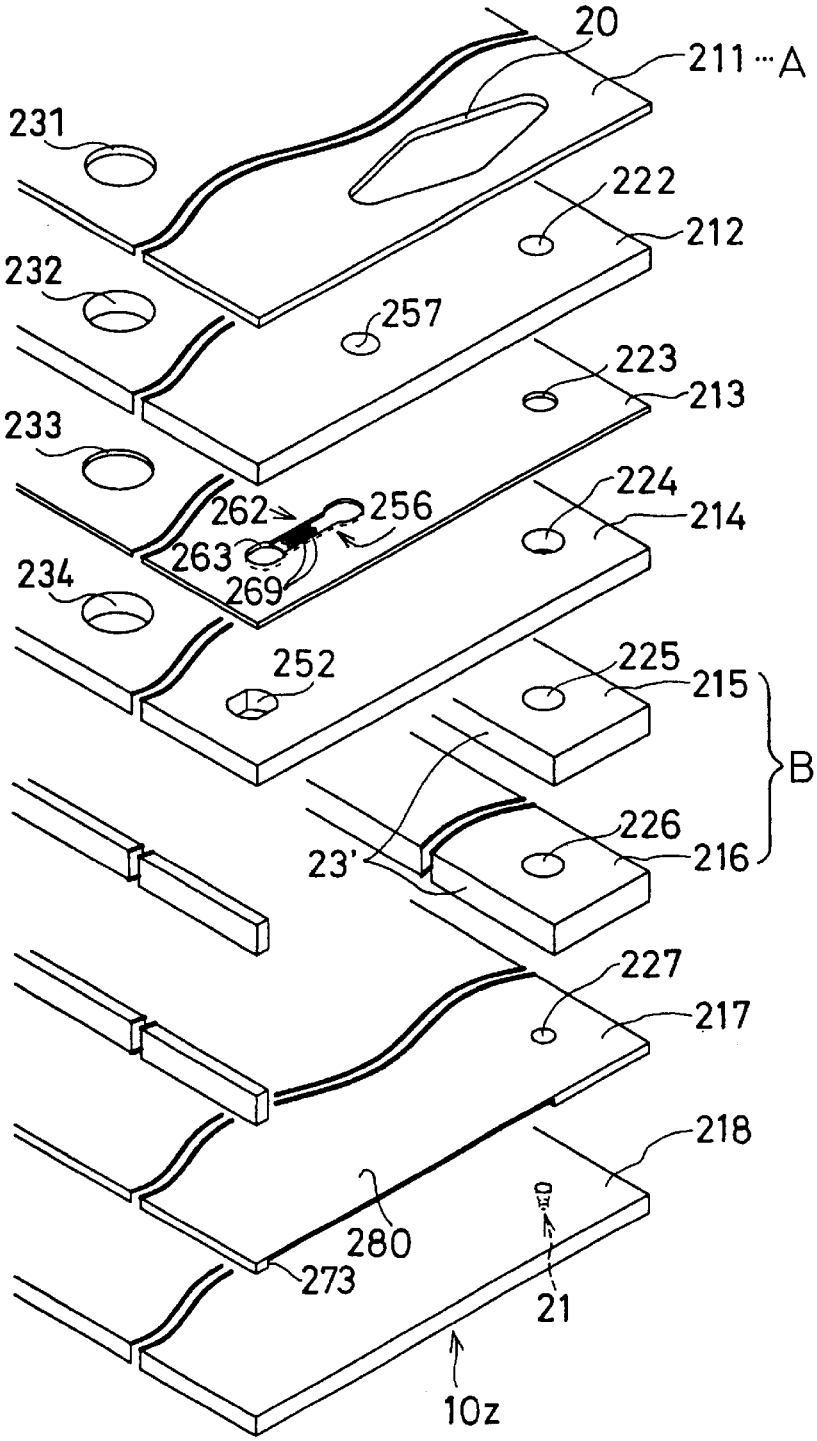
FIG. 16 is a disassembled perspective view showing a laminated structure of a set of cavity plates of the ink-jet head according to the third embodiment.

FIG. 16 is a disassembled perspective view showing a laminated structure of a set of cavity plates of the ink-jet head according to the third embodiment.

Figure 17:
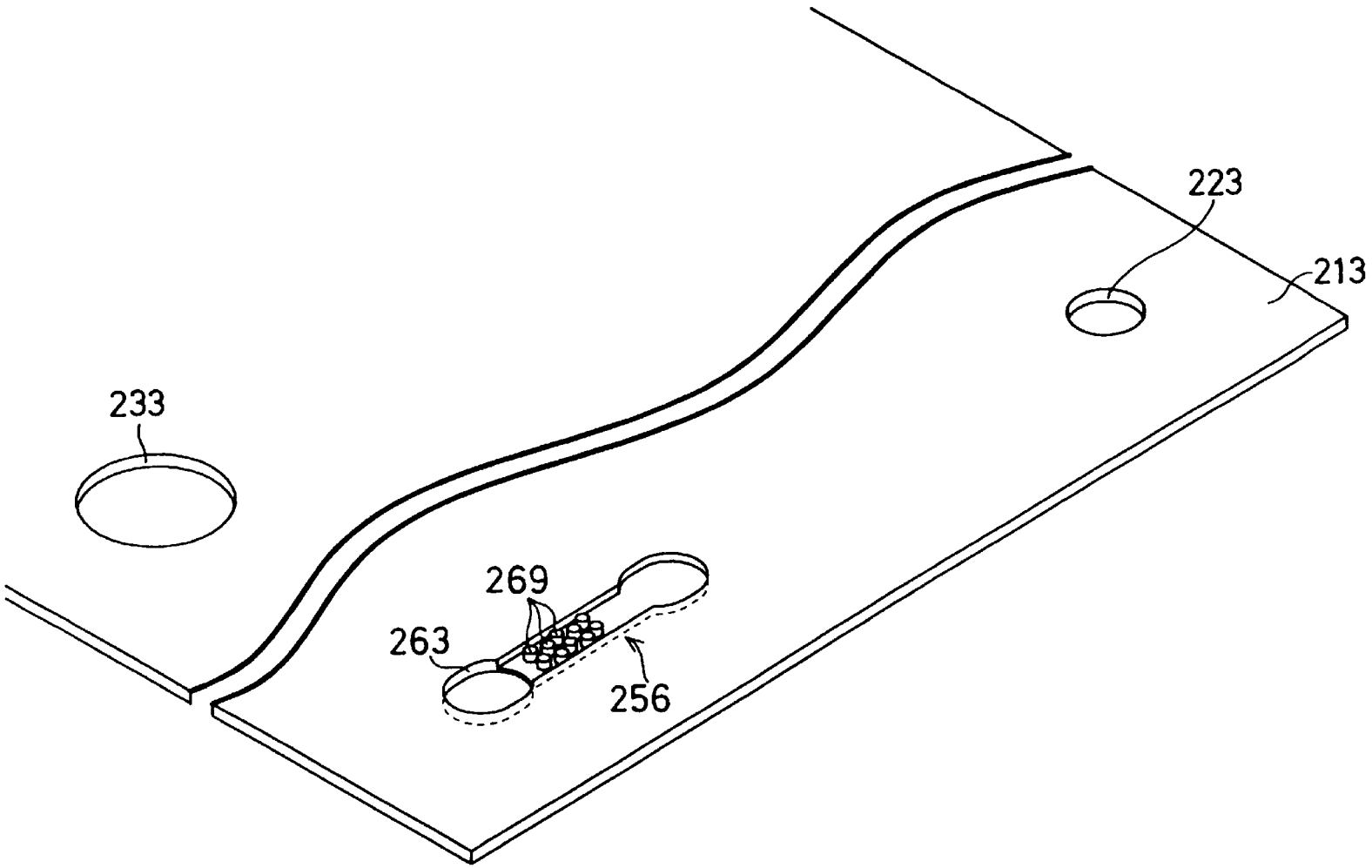
FIG. 17 is an enlarged perspective view of a third flat plate according to the third embodiment.
Figure 18:
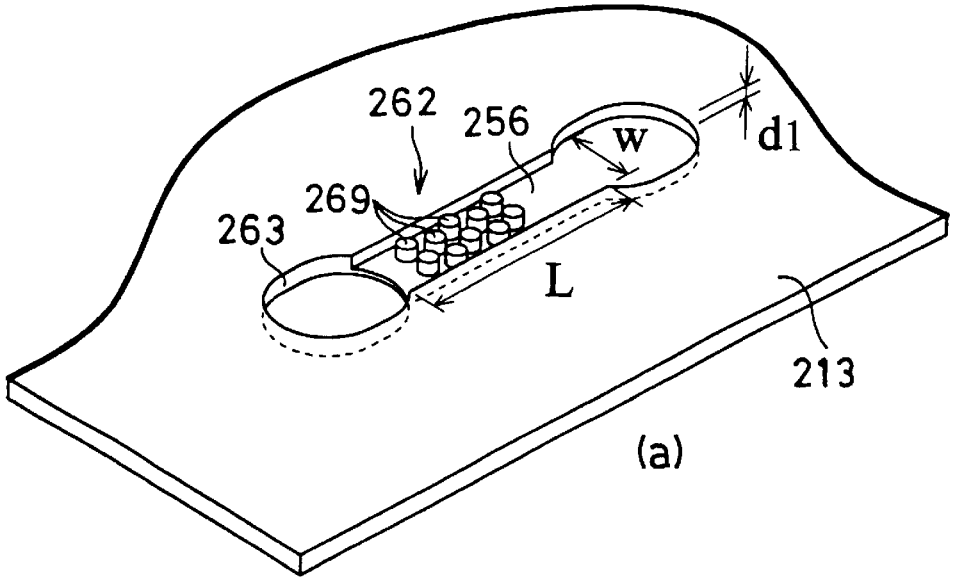
FIG. 18A is a perspective view enlarging an essential portion showing a constitution of a flow path control means according to the third embodiment.
FIG. 18B is a perspective view enlarging an essential portion showing a reference example in which a projection is not arranged in a flow path control means.
Figure 18:
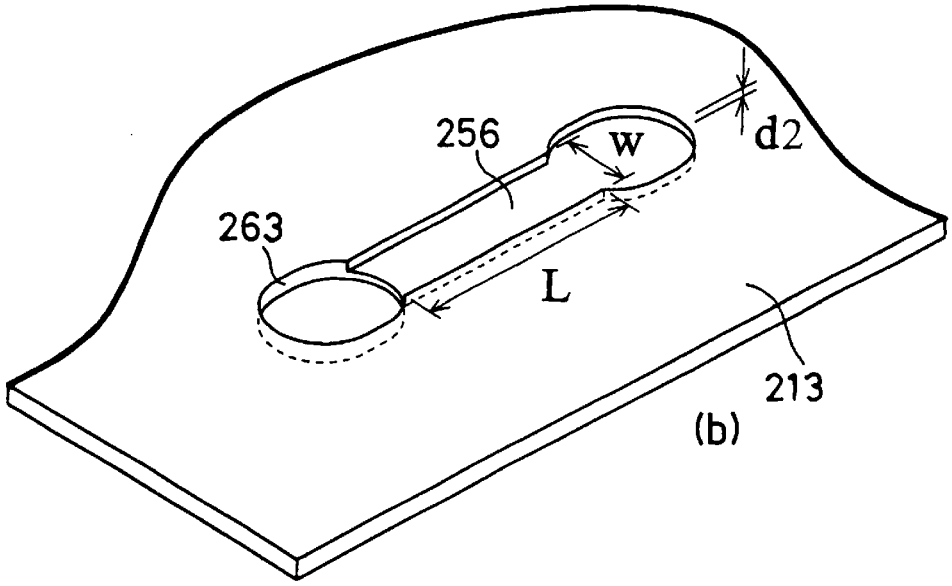

FIG. 17 is an enlarged perspective view of a third flat plate.

FIG. 18A is a perspective view enlarging an essential portion showing a constitution of a flow path control means according to the third embodiment. FIG. 18B is a perspective view enlarging an essential portion showing a reference example in which a projection is not arranged inside of a flow path control means.

Figure 19:
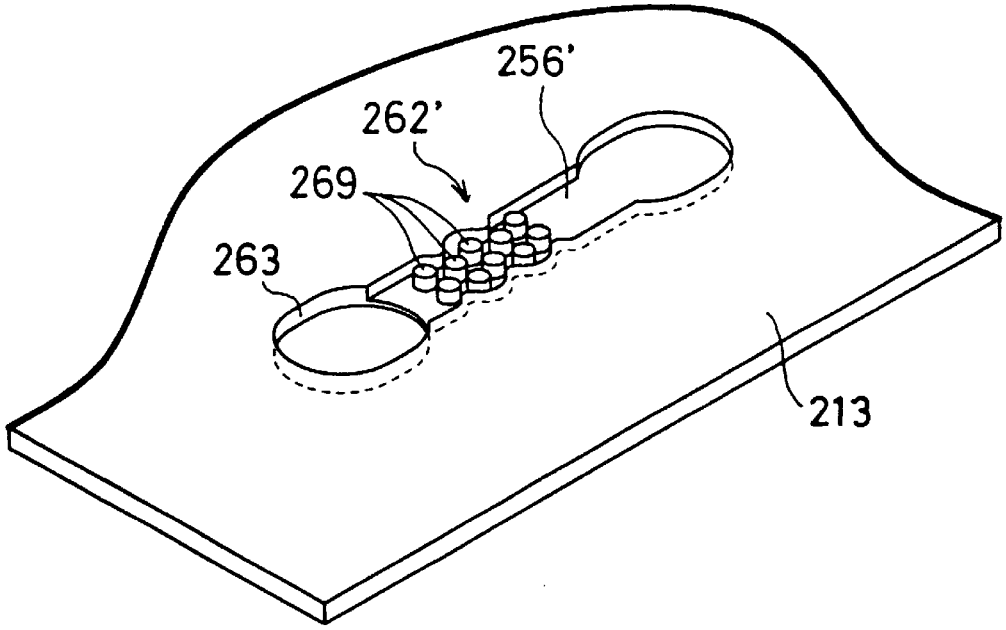
FIG. 19 is a perspective view enlarging an essential portion showing a modified example of a flow path control means.

FIG. 19 is a perspective view enlarging an essential portion showing a modified example of a flow path control means.

As shown in FIG. 14, in the head main body 1*a* of the ink-jet head according to the third embodiment, a set of cavity plates 10*z* is formed in the lamination structure of 8 sheets of thin flat plates 211 through 218 to be adhered to each other. FIG. 15 shows the laminated structure of the set of cavity plates 10*z* by a disassembled perspective view.

Further, also in the third embodiment, when each of the flat plates 211 through 218 is specified, each of the flat plates 211 through 218 is referred to as "n-th flat plate" by numbering the flat plate from a side remote from the nozzle. Further, in the description concerning the third embodiment, attention is paid to the third flat plate 213 among the eight sheets of the flat plates 211 through 218 and the third flat plate 213 may be referred to as "flat plate member".

According to the embodiment, all of the flat plates 211 through 218 are made of a metal.

Similar to the other embodiments, the pressure chamber 20 is formed as a hole penetrating the first flat plate 211 in a rhombic shape and a number them are provided by aligning in the Q direction shown in FIGS. 14 and 15.

Nozzle 21 for injecting ink is opened on the eighth flat plate 218. The second through the seventh flat plates 212 through 217 are provided with the through holes 222 through 227 to thereby form the connection flow passage 22 for connecting the pressure chamber 20 and the nozzle 11.

Both of the fifth and the sixth flat plates 215 and 216 are etched to penetrate the flat plates to thereby form the common ink chamber 23'. The common ink chamber 23' is formed to be long in the Q direction of aligning the pressure chambers 20.

According to the third embodiment, as described above, the first flat plate 211 is formed with the pressure chamber and therefore, the first flat plate 211 corresponds to the first flat plate layer A. Further, the fifth and the sixth flat plates 215 and 216 are formed with the common ink chamber 23' and therefore, the fifth and the sixth flat plates 215 and 216 correspond to the "second flat plate layer" B.

The third flat plate 213 constituting the flat plate member is disposed between the first flat plate layer A and the second flat plate layer B.

A lower face of the seventh flat plate 217 facing the common ink chamber 23' on a lower side thereof is subjected to half etching to thereby form a space (thickness reduction portion) 273 between the seventh flat plate 217 and the eighth flat plate 218.

The seventh flat plate 217 is constituted by a suitable elastic metal plate and by forming the space 273, a thinned portion here (damper portion 280) can freely be vibrated both to the side of the common ink chamber 23' and to the side of the space 273.

As a result, even when a pressure variation generated in the pressure chamber 20 in ejecting ink is propagated to the common ink chamber 23', the pressure variation can be absorbed to attenuate by damper portion 280 vibrating to be deformed (damper operation) and cross talk in which the pressure variation is propagated to other pressure chambers 20 can be prevented.

Next, an ink flow passage between the common ink chamber 23' and the pressure chamber 20 will be explained.

As shown in FIG. 15 and FIG. 16, the fourth flat plate 214 is bored with a guide hole 252 for guiding ink from the common ink chamber 23' to the pressure chamber 20. Further, a flow path control means 256 is recessed on the third flat plate 213 disposed directly above the fourth flat plate 214 to connect one end thereof to the guide hole 252.

As shown in FIG. 17, the flow path control means 256 is constituted by a slender recessed portion formed by grooving an upper face of the third flat plate 213 by half etching.

According to the constitution, when the set of cavity plates 10*z* is formed by laminating the flat plates 211 through 218, the recessed portion corresponding to the flow path control means 256 is closed by the second flat plate 212 on an upper side thereof. Therefore, ink reaching the one end of the flow path control means 256 from the guide hole 252 flows in a space between the lower face of the second flat plate 212 and the inner bottom face of the recessed portion toward the other end side of the flow path control means 256.

Further, the grooving by the half etching is carried out by a publicly-known method shown below.

That is, (1) the third flat plate 213 is subjected to a pretreatment and thereafter formed with a photosensitive resin layer by coating a suitable photosensitive resin. (2) The photosensitive resin layer is selectively exposed by using a pattern mask formed with a shape corresponding to a contour shape of the flow path control means 256. (3) A portion of the contour shape of the photosensitive resin layer is removed by development to thereby expose a corresponding portion of the third flat plate 213. (4) The flow path control means 256 is formed by coating an etching solution and carrying out a corrosion operation to the exposed portion of the third flat plate 213 by a predetermined depth. (5) The photosensitive resin layer is exfoliated to remove.

In this way, the flow path control means 256 (having a filter 262 formed therein as described hereafter) by etching the flat plate 213 and therefore, in comparison with a case of forming a filter or a flow path control means by boring the flat plate 213 by laser, fabricating steps can be simplified.

At a portion of the one end of the flow path control means 256 connected to the guide hole 252, a hole 263 in a penetrated shape is formed by carrying out etching also from the lower face of the third flat plate 213 and ink is made to flow from the guide hole 252 to the flow path control means via the hole 263.

The other end of the flow path control means 256 is connected to an end portion of the pressure chamber 20 via a through hole 257 provided on the second flat plate 212.

As shown in FIG. 18A, a sectional area of the flow path control means 256 is reduced by reducing a flow passage width w and a flow passage depth d1. With this constitution, the flow path control means 256 serves to suitably control an amount of ejecting ink from the nozzle 21 by adjusting an amount of supplying ink to the pressure chamber 20 by controlling a flow rate of ink passing the flow path control means 256.

On an inner side of the flow path control means 256, a plurality of projections (projected portions) 269 each in a shape of a circular cylinder are formed to align in a projected shape and in a shape of an independent island by being spaced apart from each other by small intervals to thereby form the filter 262. With this constitution, an impurity included in ink in the inside of the common ink chamber 23' cannot pass through clearances among the projections 269 and are caught.

The projection 269 is simultaneously formed in grooving the third flat plate 213 by half etching for forming the restriction flat passage (flow path control means 256).

That is, a pattern in correspondence with the plurality of projections 269 is also formed on the pattern mask in a selective exposure explained in the half etching method and the photosensitive resin layer is prevented from being removed at a portion corresponding to the projection 269 even in the inner portion of the flow path control means 256 in a later developing step. Thereby, when the etching solution is coated in a later step, the corrosion operation is carried out in a portion other than the portion corresponding to the projection 269 of the flat plate 213. As a result, the projection 269 remains in the projected shape. As a result of grooving the third flat plate 213 for producing the flow path control means 256 to leave the portion of the projection 269 in this way, the constitution of integrally forming the projection 269 in the inside of the flow path control means 256 is constructed.

By the above-described constitution, ink in the inside of the common ink chamber 23' reaches the flow path control means 256 from the guide hole 252 and is filtered in passing the filter 262 in the inside of the flow path control means 256 and the impurity is removed. Further, at the same time, ink is supplied to the pressure chamber 20 via the through hole 257 while the flow rate is being controlled by the operation of the flow path control means 256.

Here, flow passage resistance of the flow path control means 256 directly influences an amount of supplying ink to the pressure chamber 20 (refill amount) and therefore, an amount of injecting ink from the nozzle 21.

Therefore, it is necessary to suitably determine the flow passage resistance of the flow path control means 256 to prevent the amount of injecting ink from the nozzle 21 from being excessively large or excessively small.

The flow passage resistance is proportional to a length L of the flow path control means 256 in the longitudinal direction and inversely proportional to the sectional area of the flow passage (that is, a product of the flow passage width w by the flow passage depth d).

However, according to the embodiment, owing to the constitution of arranging the plurality of island-like projections 269 to suitably align in the inside of the flow path control means 256, the flow passage resistance can be controlled by the projections 269. That is, a difficulty of flowing of ink (flow passage resistance) can be freely controlled by varying parameters of the length L, the flow passage width w and the flow passage depth d of the flow path control means 256 as well as varying a number of pieces forming the projections 269 and a method of aligning the projections 269.

Thereby, it is facilitated to accurately determine the flow passage resistance of the flow path control means 256 to an optimum value to thereby optimize the amount of injecting ink from the nozzle 21 to promote printing quality.

Particularly, when the flow path control means 256 is formed by half etching in this embodiment, the constitution of arranging the projections 269 in the inside of the flow path control means 256 is extremely useful.

That is, with regard to the length L in the longitudinal direction and the flow passage width w in the shape and the dimensions of the flow path control means 256, by accurately drawing an exposure pattern formed by CAD over the mask for selective exposure by an automatic drawing apparatus, an error thereof can be confined to a small amount.

Meanwhile, in half etching, a rate of etching is liable to be influenced by various conditions of temperature and concentration of the etching solution and therefore, it is difficult to control the etching rate strictly and a dispersion is liable to be brought about in the etching depth. Therefore, with regard to the flow passage depth d of the flow path control means 256, in comparison with other parameters of the length L and the flow passage width w, it is unavoidable to bring about a relatively large error.

As described above, the flow passage depth d directly influences the flow passage resistance and therefore, when the flow passage resistance of the flow path control means 256 is dispersed, a situation evolves in which a large amount of ink is ejected from a certain one of the nozzles 21 and the amount of injecting ink is small in the other of the nozzles 21, which leads to a deterioration in the printing quality.

In this respect, according to the constitution of aligning the projections 269 in the inside of the flow path control means 256 as in the embodiment shown in FIG. 18A, the difficulty of passing ink (flow passage resistance) is increased by the presence of the projections 269. Therefore, even when the same flow passage resistance is intended to be achieved by the same length L and the same flow passage width w, in comparison with a constitution of FIG. 18B in which the projections 269 are not arranged, according to the constitution of FIG. 18A, the flow passage depth d can be increased by an amount corresponding to an amount of increasing the flow passage resistance by the projections 269 ($d1>d2$).

An error $\Delta d$ of corrosion depth of half etching (corresponding to an error of flow passage depth) can be restrained within a range of an absolute value of plus or minus several micrometers. Therefore, according to the embodiment in which the flow passage depth d can be increased, the influence of the error $\Delta d$ of the flow passage depth can relatively be reduced to thereby reduce also the error of the flow passage resistance of the flow path control means 256. This signifies that the dispersion in the amount of injecting ink from the respective nozzle 21 can be restrained and the printing quality can be promoted.

Further, the filter 262 for removing an impurity of ink flowing from the common ink chamber 23' to the pressure chamber 20 can be formed in the inside of the flow path control means 256 and therefore, the constitution of the flow passage including the flow path control means 256 and the filter 262 is simplified, which is adapted for space saving. Therefore, a number of the nozzles 21, the pressure chambers 20 and the flow passages communicated therewith can be arranged to integrate at high density and the demand for high resolution formation of an image and small-sized formation of the ink-jet head can easily be dealt with.

Further, according to the embodiment, the constitution of integrally forming the projections 269 constituting the filter 262 to the flat plate 213 for forming the flow path control means 256 is constructed. Therefore, in comparison with a constitution of providing a filter formed by a separate member, a number of parts can be reduced and a number of fabricating steps and the cost can be reduced.

Although according to the embodiment, the projection 269 corresponds to the "projected portion", the shape is not limited to the shape of the circular cylinder but can be constituted by an arbitrary shape of a prism or the like. Further, the plurality of projected portions 269 are not necessarily provided with the same shapes each, but free shapes can be selected for the respective projected portions.

Further, an interval between the projections 269 and an interval between the projection 269 and a side wall of the flow path control means 259 are preferably shorter than a length of a diameter (diameter) of the nozzle 21 although the intervals need to be compatible with the flow passage resistance of the flow path control means 256. Thereby, dust and dirt and an impurity of a size clogging the nozzle 21 are necessarily caught by portions of the projections 269 (the filter 262) and clogging of the nozzle 21 can be firmly prevented.

Although according to the embodiment, the recessed portion of the flow path control means 256 is formed on the third flat plate 213, the invention is not limited thereto, but the recessed portion may be formed on another flat plate according to the structural convenience of the flow passages.

Further, the invention is not limited to the constitution of forming the recessed portion of the flow path control means 256 on the upper face (face on a side remote from the nozzle 21) of the flat plate 213, but the recessed portion may be formed on a lower face thereof (face on a side proximate to the nozzle 21). In this case, the recessed portion is closed by the fourth flat plate 214 disposed directly beneath the third flat plate 213.

Further, although according to this embodiment, the width w of the flow path control means 256 is constant, the flow passage resistance can be controlled by changing the width of a portion used for providing the projections 269. Further, for example, as in a flow path control means 256' (filter 262') of FIG. 19, even on the portion providing the projections 269, irregularities may be formed on a side wall of the flow path control means 256' in correspondence with alignment or shape of the projections 269.

As shown in FIG. 16, the first through the fourth flat plates 211 through 214 are formed with connection holes 231 through 234 respectively mutually aligned. Therefore, when the flat plates 211 through 218 are laminated, as shown in FIG. 15, the connection holes 231 through 234 are linearly connected to form an ink supply passage 242. The ink supply passage 242 forms the ink supply port 41 on an upper face (face on a side opposed to a side of forming the nozzle 21) of the set of cavity plates 10*z*.

Further, when a filter is arranged intermediately on the ink supply passage 242 or to cover the ink supply port 41, an impurity included in the ink can preferably be caught before reaching the common ink chamber 23'.

Fourth Embodiment

Next, a fourth embodiment will be explained in reference to FIG. 20 through FIG. 23, wherein the flow path control means and a filter formation method for this flow path control part will be specified.

Figure 20:
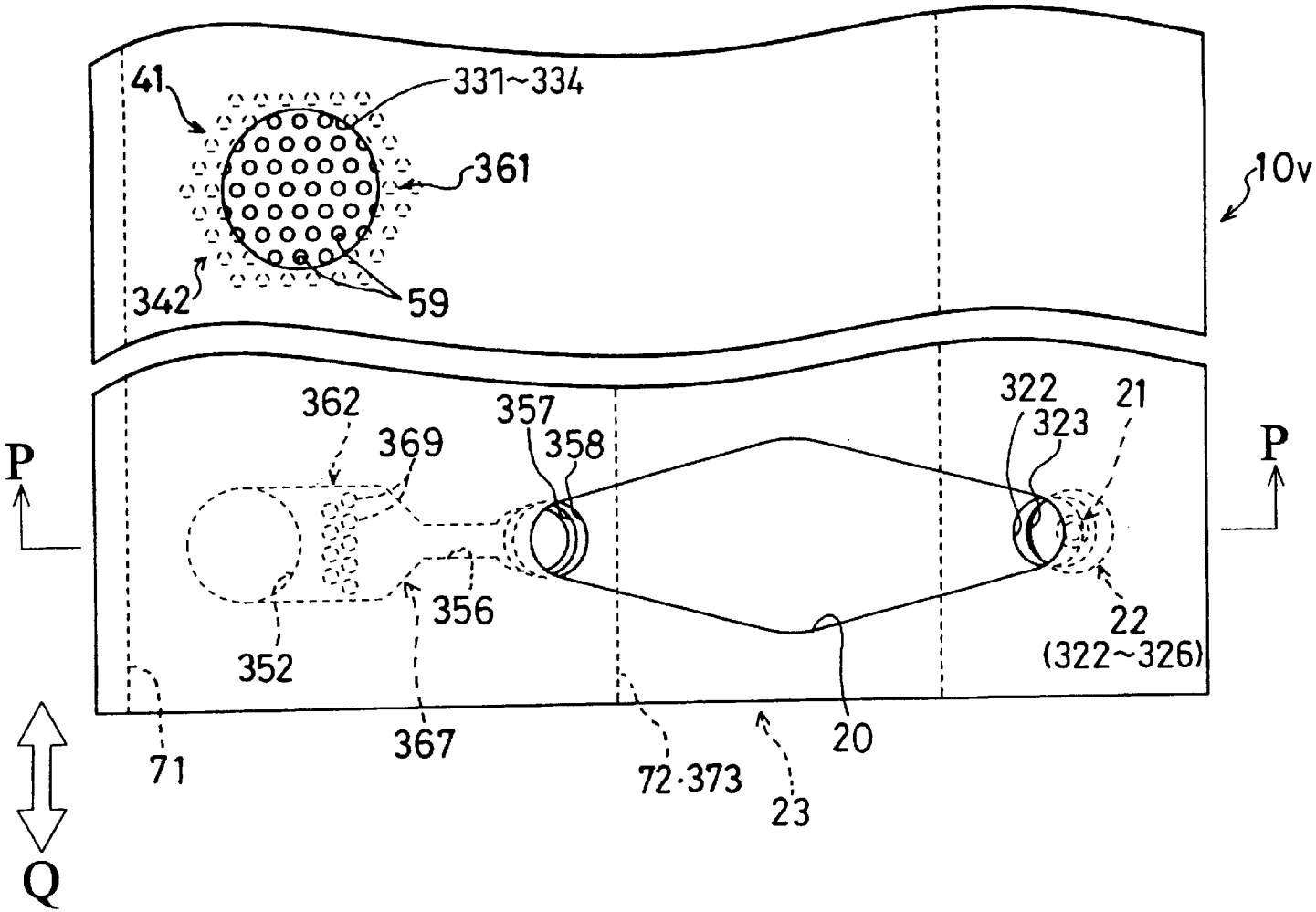
FIG. 20 is a plane view of an ink-jet head according to a fourth embodiment.

FIG. 20 is a plane view of an ink-jet head according to the fourth embodiment.

Figure 21:
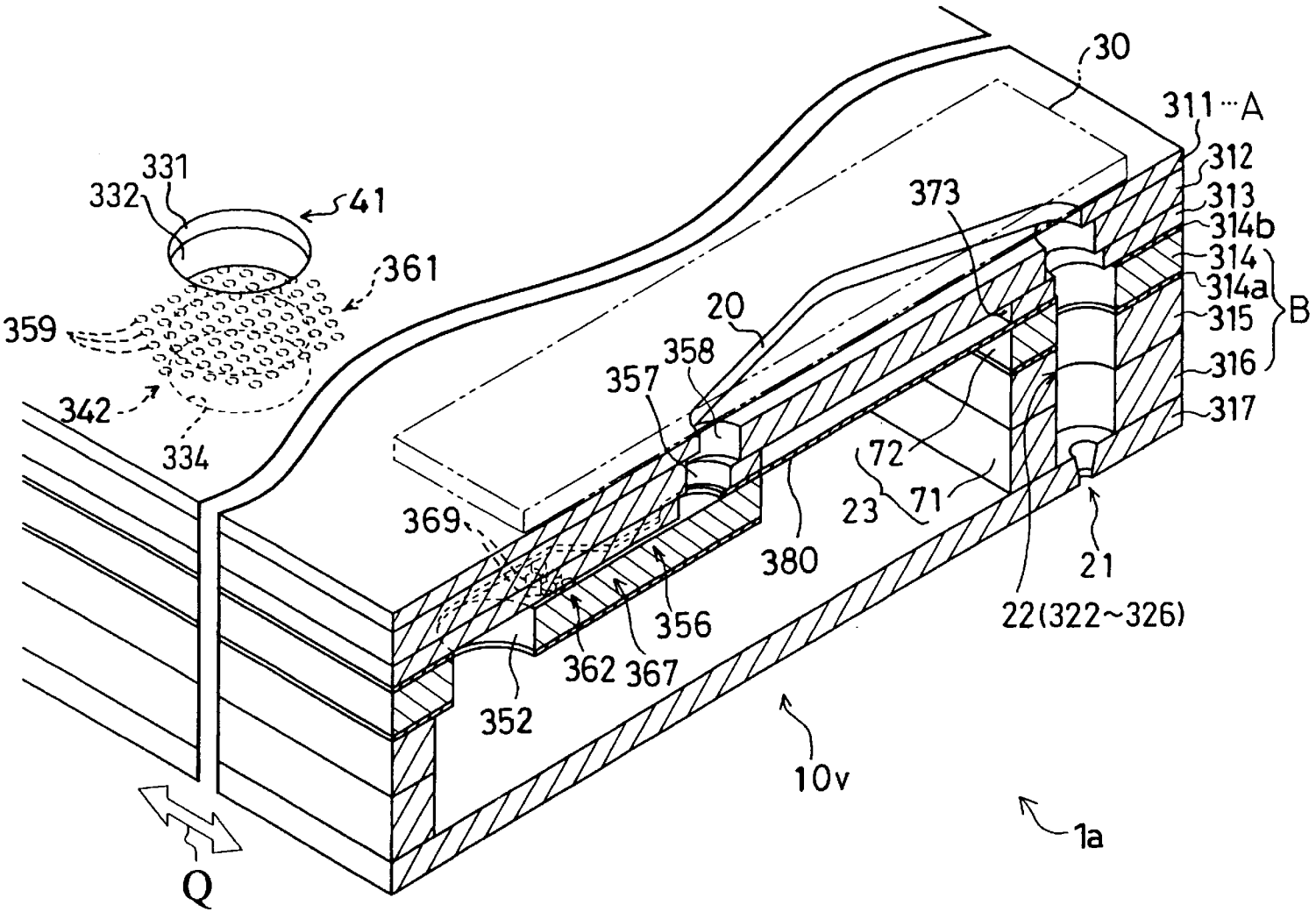
FIG. 21 is a perspective view of the ink-jet head showing a section take along the line P—P FIG. 20.

FIG. 21 is a perspective view of the ink-jet head showing a section taken along the line P—P in FIG. 20.

Figure 22:
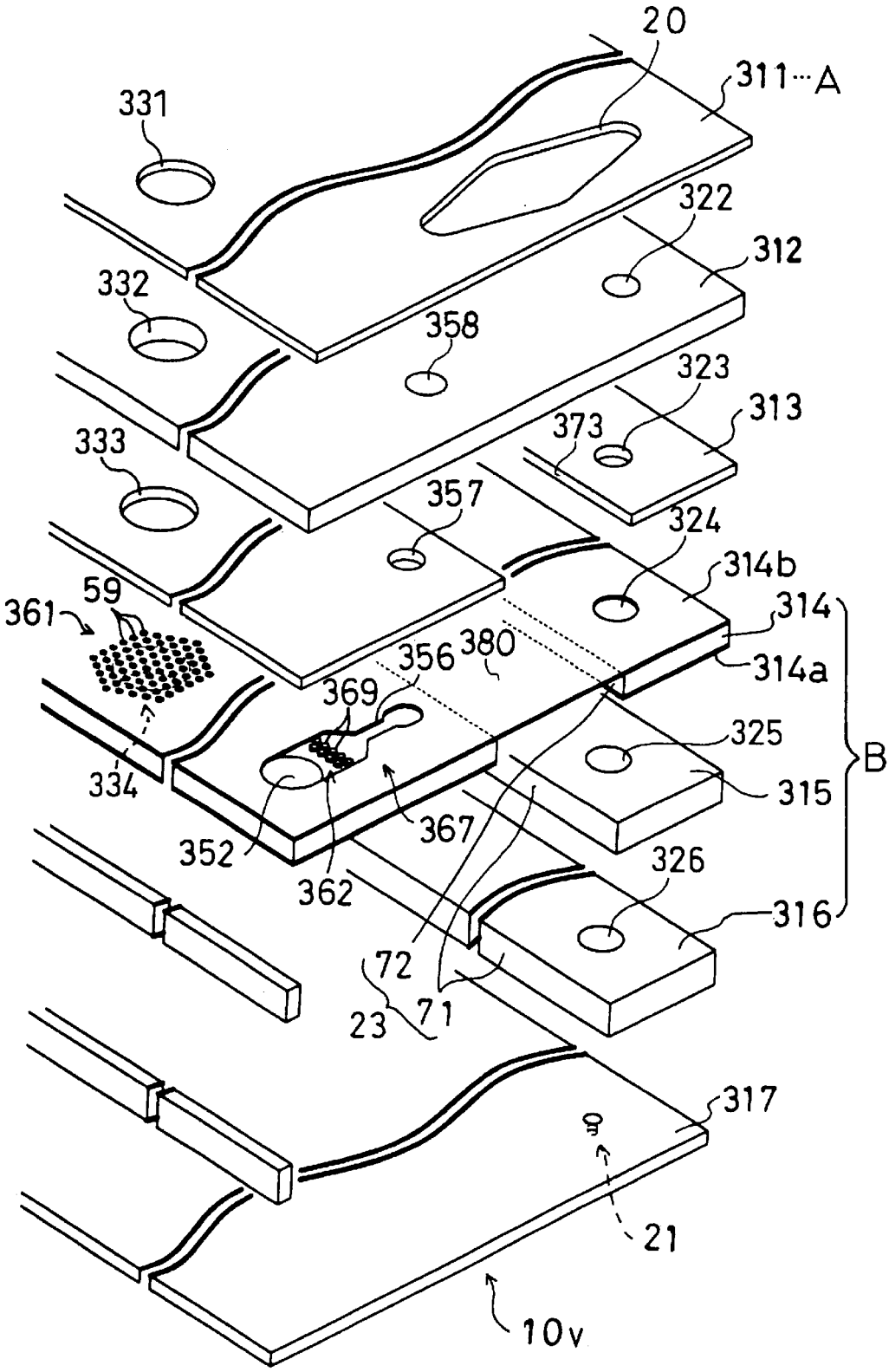
FIG. 22 is a disassembled perspective view showing a laminated structure of a set of cavity plates of the ink-jet head according to the fourth embodiment.

FIG. 22 is a disassembled perspective view showing a laminated structure of a set of cavity plates of the ink-jet head according to the fourth embodiment.

Figure 23:
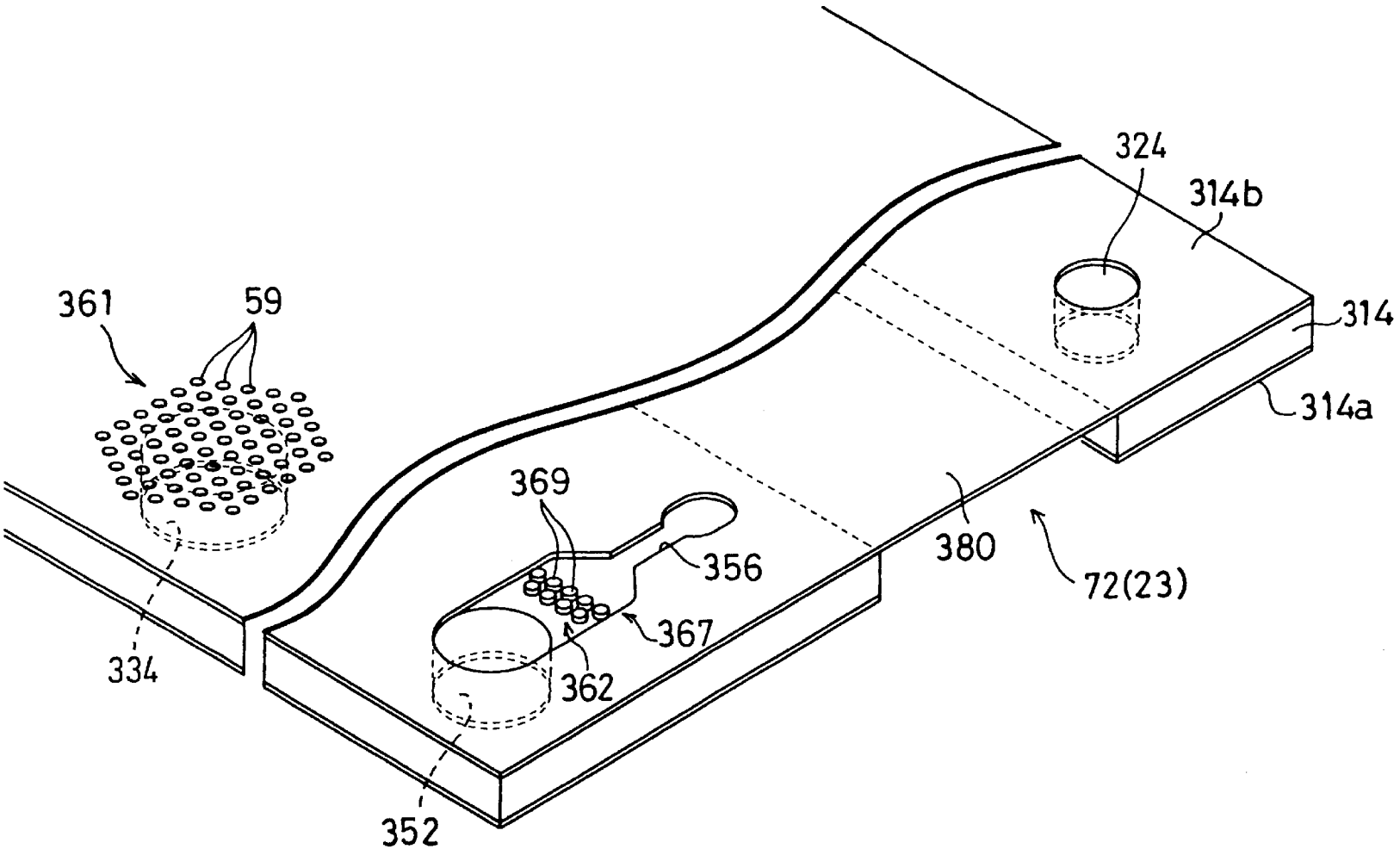
FIG. 23 is an enlarged perspective view of a fourth flat plate.

FIG. 23 is an enlarged perspective view of a fourth flat plate.

In the head main body 1*a* of the ink-jet head according to the fourth embodiment, as shown by FIG. 21, a set of cavity plates 10*v* is formed in lamination structure of seven sheets of thin flat plates 311 through 317 to be adhered to each other. FIG. 22 shows the laminated structure of the set of cavity plates 10*v* by a disassembled perspective view.

Further, also in the fourth embodiment, when each of flat plates 311 through 317 is specified, each of the flat plates 311 through 317 is referred to as "n-th flat plate" by numbering the flat plate from a side remote from the nozzle 21.

All of the flat plates 311 through 317 laminated in this embodiment are made of a metal, the fourth flat plate 314 is formed with a resin layer 314*a* arranged on a lower face of the metal flat plate, and a resin layer 314*b* arranged on an upper face, respectively. Further, according to the embodiment, attention is paid to the resin layer 314*b* on the upper face of the fourth flat plate 314 and the resin layer 314*b* may be referred to as "flat plate member".

Similar to the other embodiments, as shown in FIG. 20 and the like, the pressure chamber 20 is formed as a hole penetrating the first flat plate 311 in a rhombic shape. A number of the pressure chambers 20 are provided to align in the Q direction shown in FIG. 20 and FIG. 21.

As shown in FIG. 21 and the like, nozzle 21 for ejecting ink is opened on the seventh flat plate 317. As shown in FIG. 22, the second through the sixth flat plats 312 through 316 are provided with through holes 322 through 326 to form the connection flow passage 22 for connecting the pressure chamber and the nozzle 21 as shown in FIG. 21.

A constitution of the common ink chamber 23 will be explained.

Both of the fifth and the sixth flat plates 315 and 316 are etched to form a first space 71. Further, the fourth flat plate 314 disposed directly above the fifth flat plate 315 is also etched and the resin layer 314*a* on the lower side is also removed to thereby form a second space 72 having a width narrower than the first space 71.

According to this constitution, the common ink chamber 23 is formed by the fourth to sixth flat plates 314 to 316 laminated to each other and the first space 71 and the second space 72 adhered to each other. The common ink chamber 23 is formed to be long in the Q direction of aligning the pressure chambers 20.

According to the fourth embodiment, as described above, the pressure chamber is formed on the first flat plate 311 and therefore, the first flat plate 311 corresponds to the "first flat plate layer" A. Further, the fourth through the sixth flat plates 314 through 316 are formed with the common ink chamber 23 and therefore, the fourth through the sixth flat plates 314 through 316 (including the resin layer 314*a* on the lower face of the fourth flat plate 314) correspond to the "second flat plate layer" B.

The resin layer (flat plate member) 314*b* on the upper face of the fourth flat plate 314 is disposed between the first flat plate layer A and the second flat plate layer B.

Next, an ink flow passage between the common ink chamber 23 and the pressure chamber 20 will be explained.

The fourth flat plate 314 is bored with a guide hole 352 (first passage) for guiding ink from the common ink chamber 23 to the pressure chamber 20. Further, the resin layer 314*b* in a shape of a continuous flat plate having a uniform thickness arranged on the upper face of the fourth flat plate 314 is bored with a flow path control means (second flow passage) 367 by connecting one end thereof to the guide hole 352.

The flow path control means 367 is constituted as a deficient portion (recessed portion) removed of the resin layer 314*b* by an amount of a thickness thereof by using a method, mentioned later. When the flat plates 311 through 317 are laminated, the deficient portion of the resin layer 314*b* corresponding to the flow path control means 317 is closed by the third flat plate 313 on the upper side. Therefore, ink reaching the flow path control means 367 flows in a space between the third and the fourth flat plates 313 and 314 along the flow path control means 367.

The other end of the flow path control means 367 is connected to an end portion of the pressure chamber 20 via a through hole 357 provided at the third flat plate 313 and a through hole 358 provided at the second flat plate 312.

As shown in FIG. 20, a portion of the flow path control means 367 is formed to be wide on the side of the guide hole 352 and a plurality of projections 369 each in a shape of a circular cylinder are formed to align in a shape of an island and a projected shape by being spaced apart from each other by small intervals in the wide width portion (that is, in the inside of the flow path control means 367) to thereby form a second filter 362. According to this constitution, an impurity included in the ink in the common ink chamber 23 cannot pass through clearances among the projections 369 and is caught thereby.

A portion of the flow path control means 367 on the side of the through hole 357 constitutes a throttle member 356. The throttle member 356 is constituted by a shape of narrowing a flow passage width thereof and serves to suitably control the amount of injecting ink from the nozzle 21 by adjusting an amount of supplying ink to the pressure chamber 20 by controlling a flow rate of ink passing the flow path control means 367 between the third and the fourth flat plates 313 and 314.

According to the above constitution, ink in the inside of the common ink chamber 23 reaches the flow path control means 367 from the guide hole 352 and is filtered in passing the second filter 362 in the inside of the flow path control means 367 to remove an impurity. Further, ink reaches the throttle member 356 located in the inside of the flow path control means 367 and is supplied to the pressure chamber 20 via the through holes 357 and 358 while the flow rate is being controlled.

Next, a constitution of an ink supply passage 342 for supplying ink from an outside ink supply source to the common ink chamber 23 will be explained.

As shown by broken lines in FIG. 21 through FIG. 23, the fourth flat plate 314 is bored with a supply hole 334 and the supply hole 334 is connected to the common ink chamber 23. The resin layer 314*b* disposed at the upper face of the fourth flat plate 314 is bored to align with a number of filter holes 59 at a position corresponding to the supply hole 334 to constitute a first filter 361.

As shown in FIG. 22, the first through the fourth flat plates 311 through 313 are respectively formed with connection holes 331 through 333 by aligning to the first filter 361. The ink supply passage 342 for supplying ink from outside to the common ink chamber 23 is constituted by the supply hole 334 and the connection holes 331 through 333.

Further, according to this embodiment, a total of passages including the ink supply passage 342, the common ink chamber 23, the guide hole 352, the flow path control means 367 (including the throttle mechanism 356), the through holes 357 and 358, the pressure chamber 20 and the connection passage 22, explained above, corresponds to "ink passage" connecting the nozzle 21 and the ink supply source. As a result of connecting the ink supply source and the nozzle 21 via the ink passage, ink supplied from the ink supply source is injected from the nozzle 21 to form an image on a print face.

A damper structure for absorbing a pressure variation of the common ink chamber 23 will be explained.

The second space 72 constituting the common ink chamber 23 is formed by removing the fourth flat plate 314 and removing the resin layer on the lower face side of the fourth flat plate 314 as mentioned above. Meanwhile, the resin layer 314*b* arranged on the upper face of the fourth flat plate 314 remains as it is without being machined off even on the portion corresponding to the second space 72.

Further, also the third flat plate 313 facing the resin layer 314*b* is etched on the side opposed to the common ink chamber 23 (side remote from the nozzle 21) and a space 373 (thickness reduction portion) with a shape corresponding to the second space 72 is formed.

The resin layer (flat plate member) 314*b* is constituted to provide suitable elasticity and by forming the space 373, the resin layer 314*b* (damper portion 380) can freely be vibrated both to the side of the common chamber 23 and to the side of the space 373.

As a result, even when a pressure variation generated in the pressure chamber 20 in ejecting ink is propagated to the common ink chamber 23, the pressure variation can be absorbed to attenuate by the damper portion 380 which is elastically deformed (damper operation) to vibrate and cross talk in which the pressure variation is propagated to the other of the pressure chambers 20 can be prevented.

Next, an explanation will be given to steps of forming the two filters 361 and 362, the flow path control means 367 and the damper portion 380 according to this embodiment. All of them are formed on the resin layer (flat plate member) 314*b* arranged on the upper face of the fourth flat plate 314.

Figure 24:
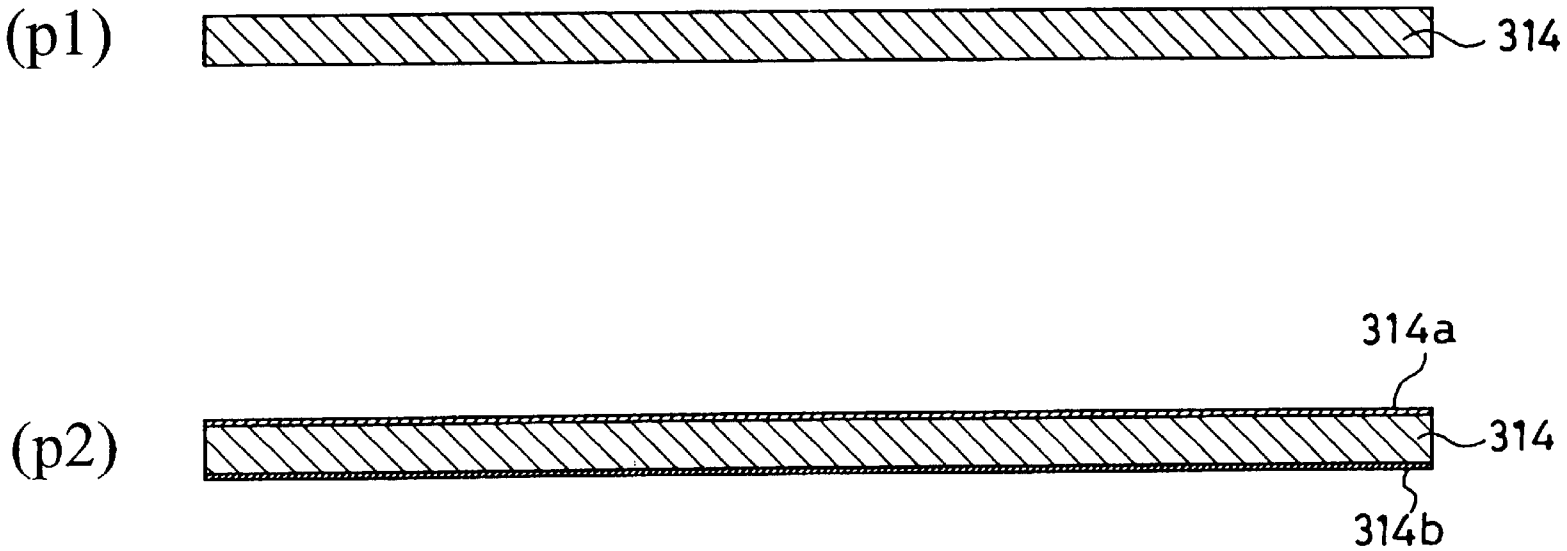
FIG. 24 is a view showing fabricating steps of the fourth flat plate.
Figure 25:
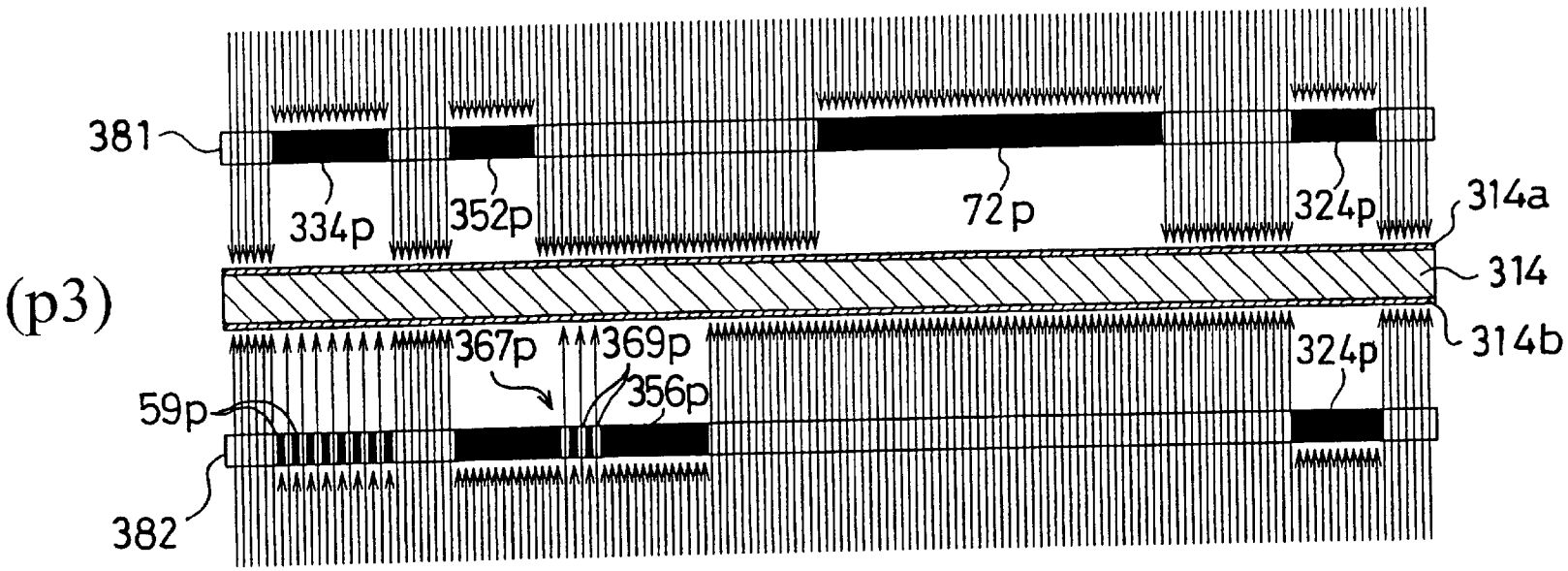
FIG. 25 is a view showing a behavior of exposing a photosensitive resin layer formed on the fourth flat plate.
Figure 26:
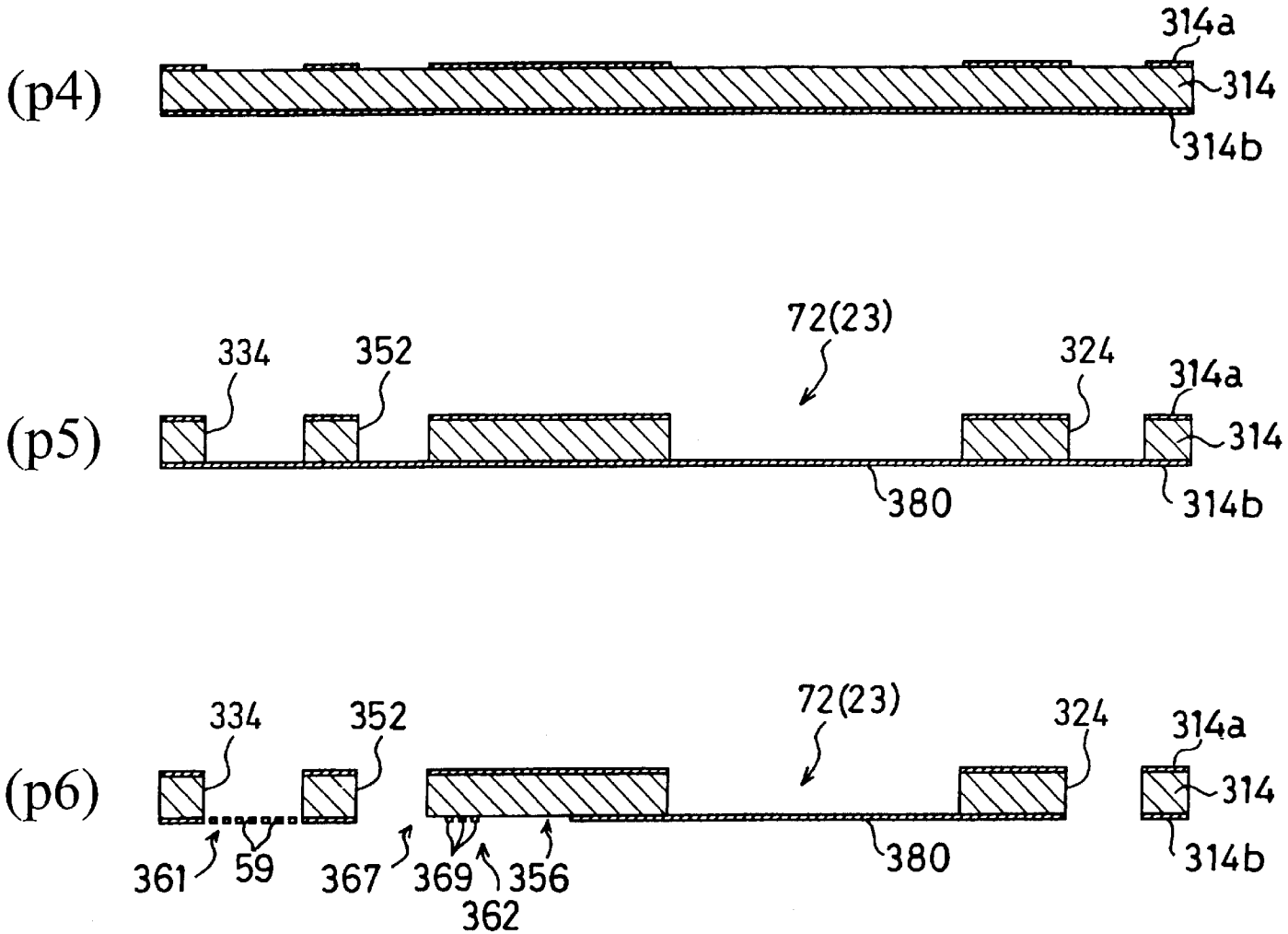
FIG. 26 is a view showing a behavior of forming a filter and a connection flow passage on the photosensitive resin layer.

FIG. 24 through FIG. 26 show fabricating steps of the fourth flat plate 314 in an order of (p1) through (p6) and an explanation will be given as follows in accordance therewith.

FIG. 24 is a view showing fabricating steps of the fourth flat plate.

FIG. 25 is a view showing a behavior of exposing a photosensitive resin layer fourth flat plate.

FIG. 26 is a view showing a behavior of forming the filters and the passage.

FIG. 24 (p1) shows the metal flat plate 314 for constituting the material of the and in this circumstance, pretreatment of cleaning and polishing is carried out d the lower faces of the flat plate 314 and thereafter, as shown by (p2), a resin is coated on one side face and a resist for etching is coated on other side face, respectively. Although various materials are conceivable as materials of the photosensitive resin and the resist for etching, in view of ink resistance, it is preferable to use resin of polyimide species or epoxy species. As a method of coating, for example, roll coating may be used.

Thereafter, the flat plate 314 is placed under a high temperature environment to thereby remove solvents in the photosensitive resin and the resist for etching (prebaking). shown in FIG. 24 (p2), the resist layer (resin layer) 314*a*, for etching and the resin layer 314*b* are formed on the flat plate 314. Hereinafter, the resin layer a is referred to as "first photosensitive resin layer" and the resin layer of is referred to as "second photosensitive resin layer", respectively.

Further, for convenience of explanation, in FIG. 24 through FIG. 26, the fourth s shown by a state of being upside down and upper and lower relationship is t shown in FIG. 21 through FIG. 23.

Next, as shown in FIG. 25 (p3), selective exposure is carried out for the upper faces of the flat plate 314 while using photomasks.

There are two of the photomasks for the upper face and the lower face and a mask 381 on the upper face side of FIG. 25 is formed with a pattern corresponding to the 24, the guide hole 352, the supply hole 334 and the second space 72 (324*p*, 352*p*, 334*p*, 72*p*).

A mask 382 on the lower face side of FIG. 25 is formed with a pattern corresponding to the through hole 324, the filter hole 59 of the first filter 361 and the flow path control means 367 (324*p*, 59*p*, 367*p*). Further, also a pattern corresponding to the throttle mechanism 356 constituting a portion of the flow path control means 367 and the projections 369 of the second filter 362 are formed on the mask 382 of the lower face side (356*p*, 369*p*).

The two masks 381 and 382 are accurately positioned to the flat plate 314 and thereafter ultraviolet ray having a suitable wavelength is irradiated from the two upper and lower faces. Thereby, the pattern on the upper side mask 381 is transcribed on the first photosensitive resin layer 314*a* and the pattern on the lower side photomask 382 is transcribed on the second photosensitive resin layer 314*b*, respectively.

Next, development is carried out by coating a developing solution to the side of the first photosensitive resin layer 314*a*, by using i.e., a spray, to thereby remove an unexposed portion of the resin layer 314*a*. As a result, as shown in FIG. 26 (p4), portions of the resin layer 314*a* corresponding to the patterns 324*p*, 352*p*, 334*p*, and 72*p* formed on the upper face side mask 381 are removed and the surface of the flat plate 314 is exposed there.

Thereafter, when an etching solution is coated to the side of the first photosensitive resin layer 314*a*, corrosion operation is carried out for the exposed portions and as shown in FIG. 26 (p5), the through hole 324, the guide hole 352, the supply hole 334 and the second space 72 are formed. Further, the second photosensitive resin layer 314*b* in the portion of the second space 72 serves as the damper portion 380.

Finally, when a developing solution is coated onto the side of the second photosensitive resin layer 314*b*, the resin layer 314*b* is removed at portions (unexposed portions) corresponding to the patterns 324*p*, 356*p*, 59*p* and 367*p* formed on the lower face side mask 382.

As a result, as shown in FIG. 26 (p6), the filter hole 59 is formed to thereby constitute the first filter 361. Further, the flow path control means 367 including the throttle mechanism 356 is formed on the second photosensitive resin layer 314*b* and connected to the guide hole 352. Further, the portion corresponding to the pattern 369*p* of the second photosensitive resin layer 314*b* is exposed and is not removed, as a result, the projections 369 remains in the projected shape in the inside of the flow path control means 367 to thereby form the second filter 362.

The fourth flat plate 314 is finished after having been processed by the above-described steps and thereafter, by overlapping and adhering the fourth flat plate 314 to other flat plates (311 through 313, 315 through 317) as shown in FIG. 22, the set of cavity plates 10*v* of the ink-jet head is constituted.

Further, in the flat plates (311 through 313, 315 through 317) other than the fourth flat plate, similar to a related art, after forming photosensitive resin layers on both faces of the respective metal flat plate layers, the two faces are exposed to develop by using masks formed with patterns in shapes corresponding to the pressure chamber 20, the communication hole 324, the common ink chamber 23 and the like and the ink passage is formed by etching onto the exposed flat plates. After the etching has been finished, the photosensitive resin layers are exfoliated.

According to this embodiment, by adopting fabricating steps shown above, the photosensitive resin layers 314*a* and 314*b* are formed on the both faces of the fourth flat plate 314, selective etching is used for the first photosensitive resin layer 314*a* to form the guide hole (first passage) 352 on the flat plate 314, the second filter 362 and the flow path control means (second passage) 367 are formed on the flat plate 314 by developing the second photosensitive resin layer 314*b* and therefore, in comparison with a constitution of providing the filter by a separate member or forming the filter or the flow passage on other metal flat plates, an effect capable of simplifying the constitution of parts and capable of reducing the number of fabricating steps is achieved.

Particularly, according to this constitution, not only the second filter 362 but also the flow path control means 367 constituting a portion of the ink passage are provided on the second photosensitive resin layer 314*b* and therefore, the flow passage structure can be simplified and a number of the laminated flat plates can easily be reduced.

Further, although the second filter 362 needs to be formed corresponding to each of the pressure chambers 20 (nozzles 21) and according to the constitution in which a number of the pressure chambers 20 are aligned as in this embodiment, a number of the second filters 362 need to be constituted, when the mask 382 formed with a number of the patterns of the second filters 362 (patterns 369*p* of the projections 369) is used, a number of the second filters 362 can be formed in one operation by a one time exposure and development and the fabrication is extremely facilitated.

The mask 382 is formed with the second filter (that is, filter arranged in the flow passage connecting the pressure chamber 20 and the common ink chamber 23) 362 and formed with the first filter (that is, filter arranged in the ink supply passage 342) 361. Therefore, an impurity can be prevented from mixing into the common ink chamber 23 by the first filter 361 and an impurity can be hampered from reaching the pressure chamber 20 and the nozzle 21 by the second filter 362. Further, both of the two filters 361 and 362 can be formed by the pattern of the mask 382 and therefore, fabricating steps are simplified.

Further, in this embodiment, the second filter 362 is provided in the flow path control means 367 and therefore, the flow path control means 367 and the second filter 362 can be arranged in a small space, and the flow passage structure can be simplified. This can contribute to compact formation of the ink-jet head. Further, the embodiment is adapted for high density arrangement of the flow passage and is easily applied to a printing mode having high resolution which needs highly integrated arrangement of the nozzles 21.

Further, the flow path control means 367 for controlling flow of ink to the pressure chamber 20 is constituted on the second photosensitive resin layer 314*b* as the second flow passage and therefore, the flow passage resistance of the flow path control means 367 can be easily and accurately determined.

That is, the flow passage resistance of the flow path control means 367 directly influences the amount of supplying ink to the pressure chamber 20 (refill amount) and therefore, the amount of ejecting ink from the nozzle 21 and therefore, in order to prevent excess or deficiency of the amount of ejecting ink from the nozzle 21, it is extremely important to accurately form dimensions and the shape of the flow path control means 367 with excellent precision.

In this respect, according to the constitution of this embodiment, the thickness of the second photosensitive resin layer 314*b* can accurately be determined by suitably selecting conditions of coating and therefore, the flow path control means 367 having accurate dimensions can be formed by completely removing the contour shape of the flow path control means 367 in correspondence with the mask pattern shape in the exposing step by an amount of the thickness in the developing step. That is, in comparison with a constitution of forming the flow path control means by, for example, grooving the metal flat plate by half etching (for example, the constitution of the third embodiment), the accuracy of the depth of the flow path control means 367 can be promoted and therefore, error or dispersion of the flow passage resistance can be reduced and printing quality can be improved.

Further, similar to the third embodiment, the difficulty of the flow of ink (flow passage resistance) can be freely controlled by varying the number of pieces forming the projections 369 and the method of aligning the projections 369. Thereby, it is easy to accurately determine the flow passage resistance of the flow path control means 367 to an optimum value and the amount of ejecting ink from the nozzle 21 is optimized to thereby improve the printing quality.

Further, as shown in FIG. 22, the second photosensitive resin layer 314*b* constituting the flat plate member faces the common ink chamber 23 (constituting a portion of the "ink passage"), the space 373 constituting the thickness reduction portion is formed on the flat plate (third flat plate 313) on the opposed side interposing the resin layer 314*b* and therefore, the pressure variation propagated to the ink passage can be absorbed to attenuate by vibrating the second photosensitive resin layer 314*b* (damper portion 380) between the space 373 and the ink passage. Therefore, printing can suitably be achieved by controlling the pressure variation affecting adverse influence on the quality of ejection of ink from the nozzle 21. According to this embodiment, the damper portion 380 is fabricated to be included in the second photosensitive resin layer (the flat plate member) 314*b*, as a result, the constitution and the integration of parts can be further simplified.

Although according to this embodiment, a positive type (photocuring type) is used for the photosensitive resin and the resist for etching, the embodiment is not limited thereto but a negative type (photodecomposing type) may be adopted. Although in that case, the exposed portion is conversely removed in development, when the masks 381 and 382 formed with patterns switching the exposed portion and the unexposed portion are used, a structure similar to the above-described can be formed.

Further, it is not necessarily needed to proceed with the steps in accordance with the above-described order. For example, the first photosensitive resin layer 314*a* may be formed after forming the second photosensitive resin layer 314*b*. Further, the both faces of the flat plate 314 may not be exposed in one operation as shown in FIG. 25, but the flat plate 314 may be exposed face by face.

Although according to this embodiment, the filter hole 359 of the first filter 361 is also formed on the second photosensitive resin layer 314*b*, the embodiment is not limited thereto but the filter hole 359 may be formed on other flat plates. However, according to the constitution of the embodiment in which the first filter 361 is also arranged on the second photosensitive resin layer 314*b*, by only exposing and developing the second photosensitive resin layer 314*b*, not only the second filter 362 and the flow path control means 367 but also the first filter 361 can be formed in one operation and therefore, fabrication steps can be further simplified.

Figure 27:
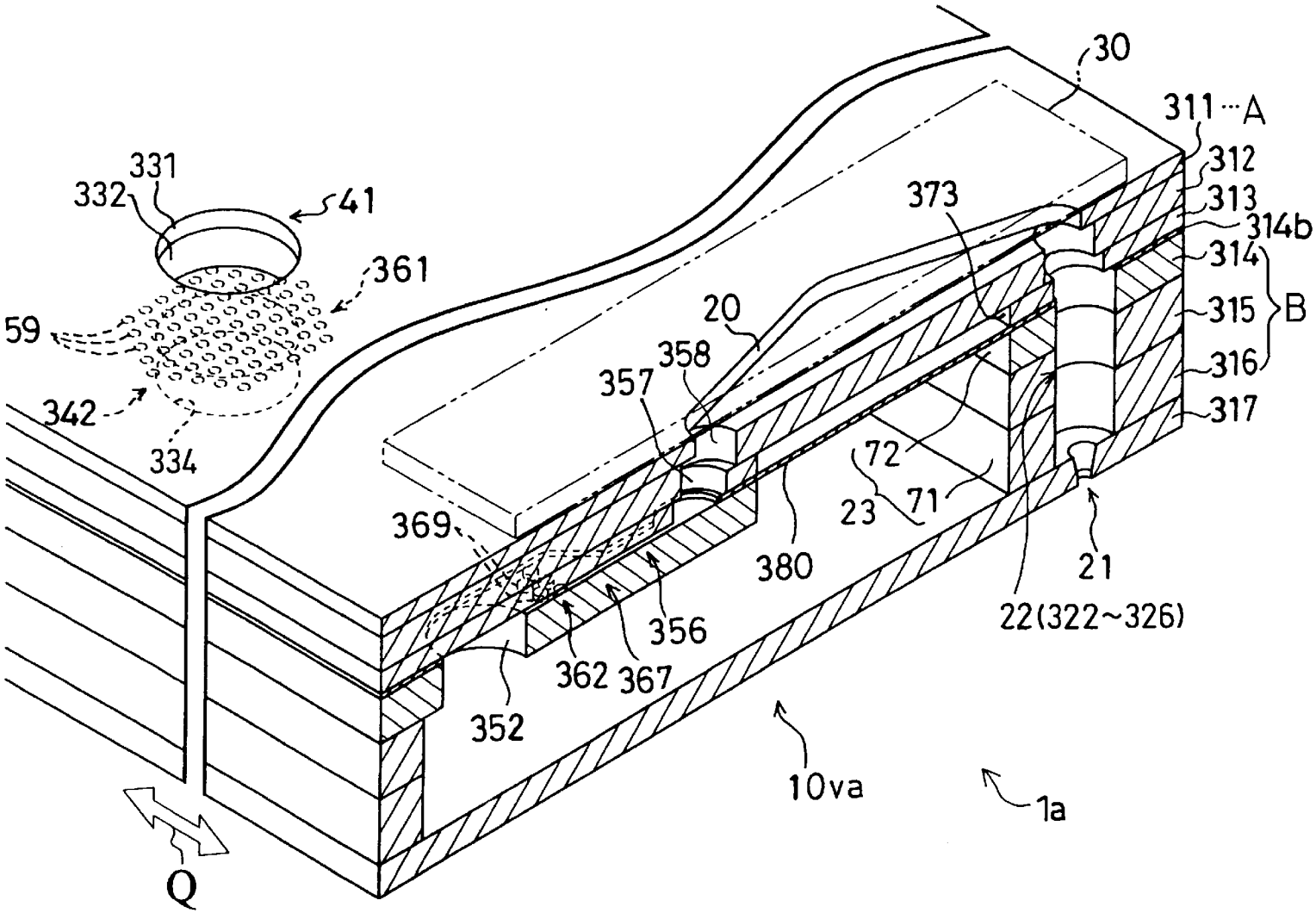
FIG. 27 is a perspective view of a section of the ink-jet head showing a modified example of removing a resin on one side of the fourth flat plate of the fourth embodiment.

Although according to the fourth embodiment explained above, the flat plates 311 through 317 are laminated in a state in which the first photosensitive resin layer 314*a* remains to thereby form the ink-jet head, the first photosensitive resin layer 314*a* may be removed at least before lamination. A constitution of removing the first photosensitive resin layer 314*a* is shown in a set of cavity plates 10*va* as a modified example of the fourth embodiment a (FIG. 27). Although the first photosensitive resin layer 314*a* may be removed immediately before lamination, the first photosensitive resin layer 314*a* may be removed by adding a step of removing the first photosensitive resin layer 314*a* between (p5) and (p6) in the steps of FIG. 24 through FIG. 26.

In this case, the step can be realized by suitably selecting materials of the first photosensitive resin layer 314*a* and the second photosensitive resin layer 314*b* so that a developing solution (solvent) for developing the first photosensitive resin layer 314*a* (selective removal in accordance with exposure and nonexposure) may not attack the unexposed or the exposed second photosensitive resin layer 314*b*.

Fifth Embodiment

Next, a fifth embodiment will be explained in reference to FIG. 28 through FIG. 31. Difference between this fifth embodiment and the fourth embodiment resides in that a flow path (second passage) formed on the second photosensitive resin layer 314*b* is not directly connected to a flow passage (first passage) formed on the fourth flat plate 314'.

Figure 28:
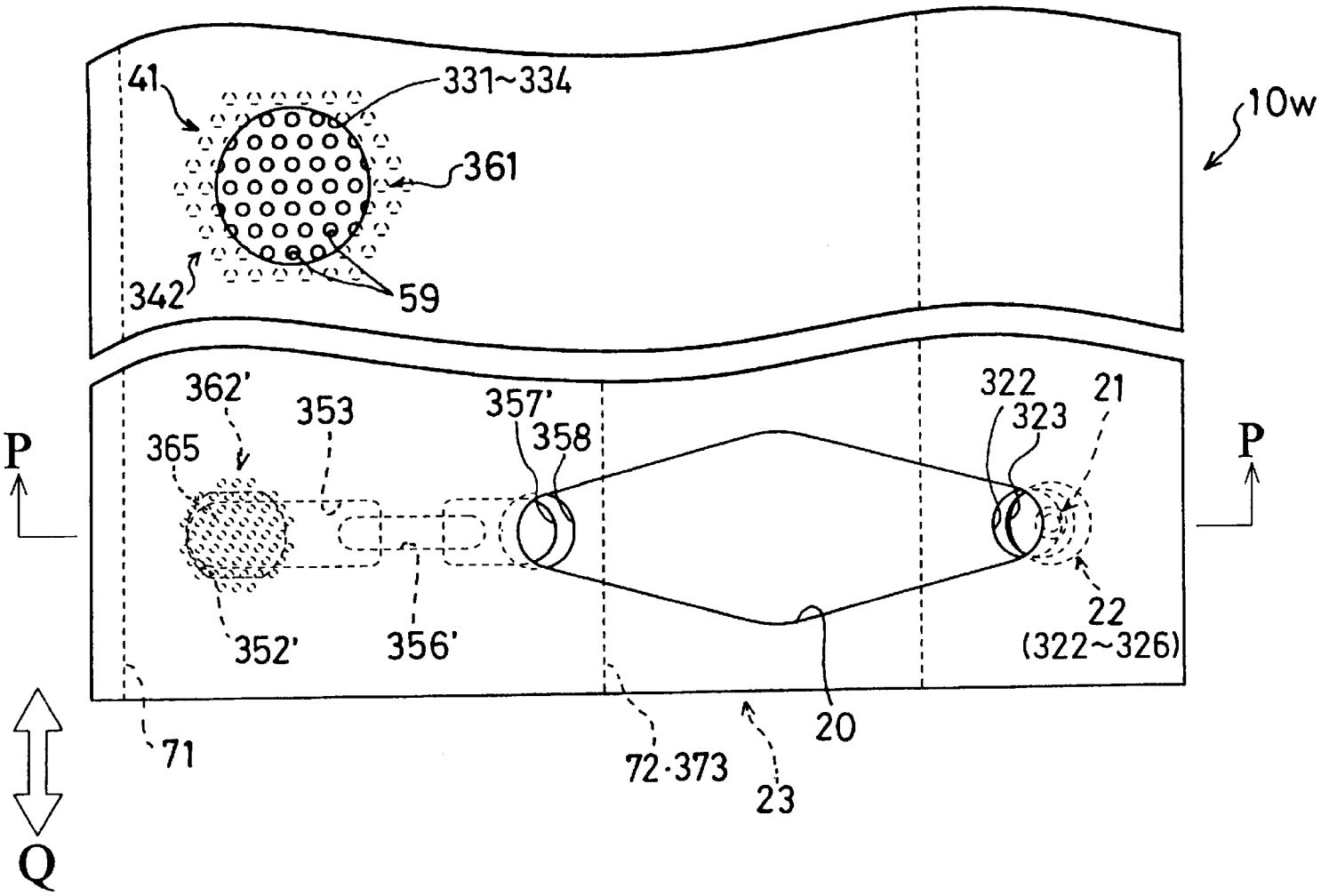
FIG. 28 is a plane view of an inkjet head according to a fifth embodiment.

FIG. 28 is a plane view of an ink-jet head according to the fifth embodiment.

Figure 29:
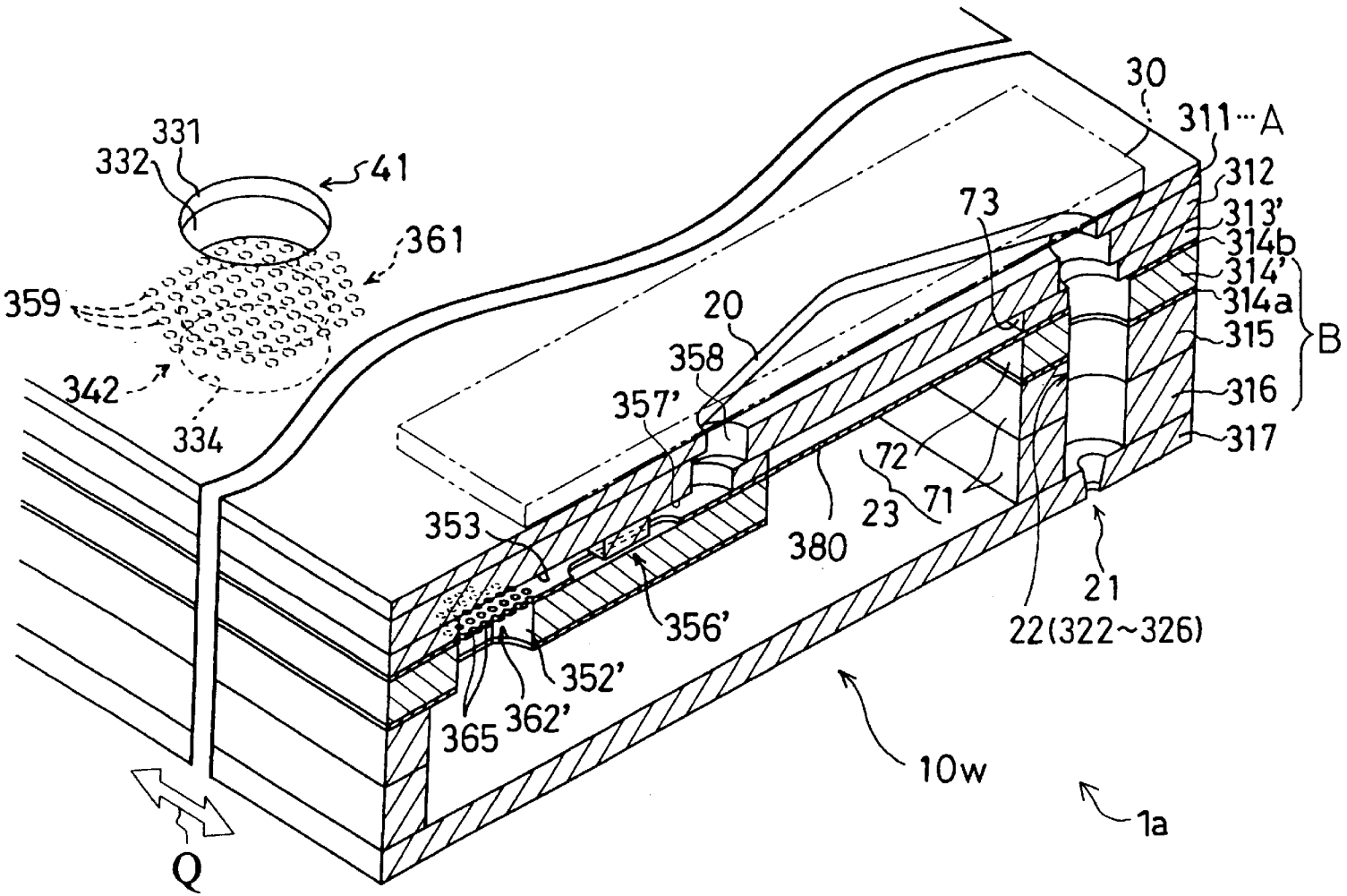
FIG. 29 is a perspective view of the ink-jet head showing a section taken along the line P—P of FIG. 28.

FIG. 29 is a perspective view of the ink-jet head showing a section taken along the line P—P of FIG. 28.

Figure 30:
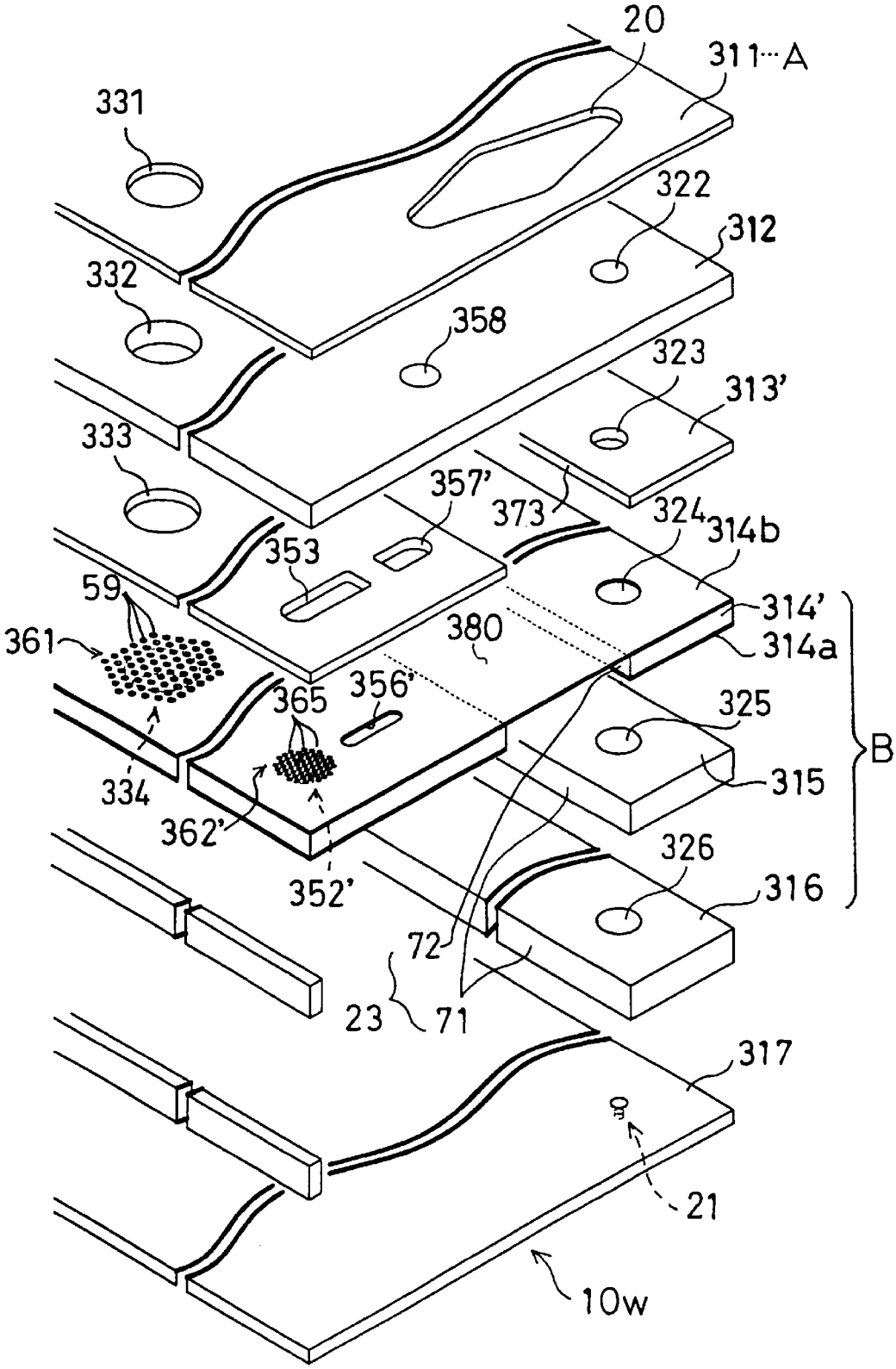
FIG. 30 is a disassembled perspective view showing a laminated structure of a set of cavity plates of the ink-jet heads according to the fifth embodiment.

FIG. 30 is a disassembled perspective view showing a laminated structure of a set of cavity plates of the ink-jet head according to the fifth embodiment.

Figure 31:
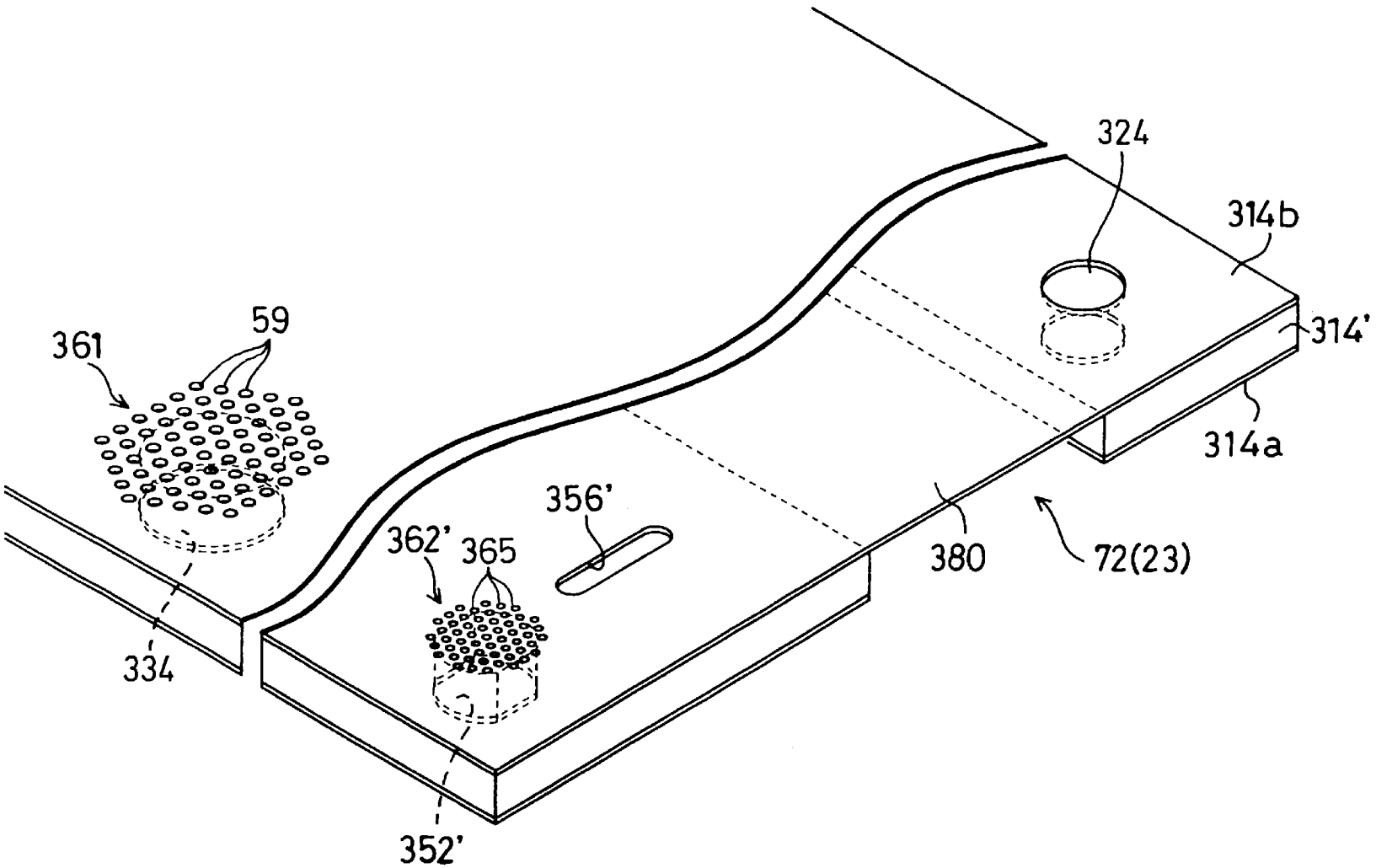
FIG. 31 is an enlarged perspective view of a fourth flat plate.

FIG. 31 is an enlarged perspective view of a fourth flat plate.

The ink-jet head of the fifth embodiment shown in FIG. 28 through FIG. 31 differs from the fourth embodiment in a constitution of a flow passage reaching the pressure chamber 20 from the common ink chamber 23 formed in the inside of a set of cavity plates 10*w*.

The constitution of the flow passage will be explained. As shown in FIG. 29 and the like, a first guide hole 352' constituting a first passage is formed on a fourth flat plate 314' and connected to the common ink chamber 23. Further, a number of the filter holes 365 are aligned to bore on the resin layer 314*b* arranged on the upper face of the fourth flat plate 314' by aligning to the guide hole 352' to thereby constitute a second filter 362'. Further, on the resin layer 314*b*, a flow path control means (second passage) 356' in a shape of a long hole is formed at a position at a side of the second filter 362' and one end of the flow path control means 356' and the guide holes 352 are connected via a connection flow passage 353 formed on a third flat plate 313'. The other end of the flow path control means 356' is connected to the pressure chamber 20 via through holes 357' and 358.

Further, the fifth embodiment is formed with no filter formed in the inside of the flow path control means 356' and the second filter 362' is arranged at the guide hole 352' part.

Also according to this ink-jet head, the filter holes 365 of the second filter 362' and the flow path control means 356' are formed by exposing and developing the second photosensitive resin layer 314*b* by using a mask. The other constitution and the method of fabricating the fourth flat plate 314' are quite similar to those of the ink-jet head according to the fourth embodiment.

Further, in place of the steps of FIG. 25 through FIG. 27, there may be used steps of (1) carrying out a pretreatment similar to that in the above-described embodiment on the fourth flat plate 314, (2) thereafter forming only the first photosensitive resin layer 314*a* on one face of the fourth flat plate 314, (3) exposing the first photosensitive resin layer 314*a* by a pattern, (4) developing the first photosensitive resin layer 314*a* similar to (p5) of the above-described embodiment, (5) forming the flow passage by etching similar to (p5) of the above-described embodiment, (6) forming the second photosensitive resin layer 314*b* on other face of the fourth flat plate 314, (7) exposing the second photosensitive resin layer 314*b* by a pattern, and (8) developing the second photosensitive layer 314*b* similar to (p6) of the above-described embodiment to thereby form the filter portion and the like.

Although in this case, it is most preferable to use a method of pasting the second photosensitive resin layer 314*b* in a film-like shape so that the flow passage formed by the etching step (5) may not be closed, when physical properties (fluid characteristic) of a viscosity and drying property of a resist material for forming the second photosensitive resin layer 314*b* are suitably adjusted, a liquid state one can be utilized.

Although according to the first through the fifth embodiments, the first flat plate layer A comprises one sheet of a flat plate and the second flat plate layer B comprises a plurality of sheets of flat plates, the invention is not limited thereto. That is, the first flat plate layer A may be constituted by two or more flat plates and the second flat plate layer B may be constituted only by one flat plate.

What is claimed is:

1. A method of fabricating an ink-jet head having a nozzle that ejects ink, an ink passage connecting the nozzle and an ink supply source a plurality of flat plates having the ink passage formed inside in a lamination structure, said method of fabricating an inkjet head comprising:

(A) forming a first photosensitive resin layer on one face of a metal flat plate of the plurality of flat plates;

(B) forming a second photosensitive resin layer on an opposite face of metal flat plate;

(C) selectively exposing the first photosensitive resin layer by using a mask formed with a pattern corresponding to a first passage partially constituting the ink passage;

(D) removing an exposed portion or an unexposed portion of the first photosensitive resin layer;

(E) forming the first passage by etching the flat plate to form a shape corresponding to a removed portion of the first photosensitive resin layer;

(F) selectively exposing the second photosensitive resin layer by using a mask formed with a pattern corresponding to a second passage partially constituting the ink passage and a filter;

(G) forming the second passage connected to the first passage and the filter by removing an exposed portion or an unexposed portion of the second photosensitive resin layer; and (H) laminating the flat plate processed by the steps of (A) through (G) onto other flat plates of the plurality of flat plates.

2. The method of fabricating an inkjet head according to claim 1, wherein the pattern corresponding to the second passage and the filter includes a pattern that forms the filter in the second passage.

3. The method of fabricating an inkjet head according to claim 1, wherein the ink-jet head includes a pressure chamber that controls the ink ejected at the nozzle and a common ink chamber that distributes the ink to the pressure chamber, and the pattern corresponding to the second passage and the filter includes a pattern that forms the filter in a flow passage connecting the pressure chamber and the common ink chamber.

4. The method of fabricating an ink-jet head according to claim 1, wherein the ink-jet head includes a pressure chamber that controls the ink ejected at the nozzle, a common ink chamber that distributes the ink to the pressure chamber and an ink supply passage that supplies the ink from the ink supply source to the common ink chamber, and the pattern corresponding to the second passage and the filter includes a pattern that forms the filter in the ink supply passage.

5. The method of fabricating an ink-jet head according to claim 1, wherein the inkjet head includes a pressure chamber that controls the ink ejected at the nozzle, a common ink chamber that distributes the ink to the pressure chamber and an ink supply passage that supplies the ink from the ink supply source to the common ink chamber, and the pattern corresponding to the second passage and the filter includes a pattern that forms the filter in a flow passage connecting the pressure chamber and the common ink chamber and another filter in the ink supply passage.

6. The method of fabricating an ink-jet head according to claim 1, wherein the ink-jet head includes a pressure chamber that controls the ink ejected at the nozzle, and the second passage is a flow path control means that controls a flow of the ink to the pressure chamber.

7. The method of fabricating an in-jet head according to claim 1, wherein the ink-jet head includes a pressure chamber that controls the ink ejected at the nozzle and a common ink chamber that distributes the ink to the pressure chamber, and a thickness reduction portion is formed on the flat plate facing the common ink chamber on an opposed side thereof by interposing the second photosensitive resin layer on the side of the other flat plates.

* * * * *